US005972554A

United States Patent [19]

Nagatsuka et al.

[11] Patent Number: 5,972,554

[45] **Date of Patent: *Oct. 26, 1999**

[54] TONER FOR DEVELOPING ELECTROSTATIC IMAGES

[75] Inventors: Takayuki Nagatsuka, Yokohama; Hirohide Tanikawa; Makoto Unno, both of Shizuoka-ken, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/064,126

[22] Filed: Apr. 22, 1998

[30] Foreign Application Priority Data

Apr. 30, 1997 [JP] Japan ..... 9-112010

[51] Int. Cl.[6] ..... G03G 9/097

[52] U.S. Cl. ..... 430/110

[58] Field of Search ..... 430/110

[56] References Cited

U.S. PATENT DOCUMENTS

| | | | |
|---|---|---|---|
| 3,879,196 | 4/1975 | Nagashima et al. | 430/107 |
| 3,956,021 | 5/1976 | Clemens et al. | 430/109 |
| 5,049,467 | 9/1991 | Yamanaka et al. | 430/110 |
| 5,290,652 | 3/1994 | Harakawa et al. | 430/110 |
| 5,318,883 | 6/1994 | Yamanaka et al. | 430/110 |
| 5,714,292 | 2/1998 | Anno et al. | 430/110 |
| 5,736,289 | 4/1998 | Sukata et al. | 430/110 |

FOREIGN PATENT DOCUMENTS

| | | |
|---|---|---|
| 0651294 A1 | 5/1995 | European Pat. Off. . |
| 0712049 A1 | 5/1996 | European Pat. Off. . |
| 2-266462 | 11/1988 | Japan . |
| 2-201378 | 8/1990 | Japan . |
| 1286825 | 8/1972 | United Kingdom . |

OTHER PUBLICATIONS

Database WPI, Section Ch, Week 9226, Derwent Publ., Class A05, AN 92–212167, XP 002095778 for JP 04–139456.

*Primary Examiner*—Roland Martin
*Attorney, Agent, or Firm*—Fitzpatrick, Cella, Harper & Scinto

[57] ABSTRACT

A toner for developing electrostatic images is formed of toner particles comprising a binder resin and a colorant, and inorganic fine powder. The toner further contains: a phenol-aldehyde condensate mixture comprising an acyclic condensate and a cyclic condensate, respectively, of a phenol compound with an aldehyde compound, and the phenol-aldehyde condensate mixture contains 10–80 mol % of condensate components having 4–6 phenolic units. The phenol-aldehyde condensate mixture may be contained in or externally added to the toner particles. Because of the inclusion of an acyclic condensate and appropriate amount of condensate components having 4–6 phenolic units, the phenol-aldehyde condensate mixture may exhibit a good dispersibility in the binder resin and a good charge control performance.

30 Claims, 1 Drawing Sheet

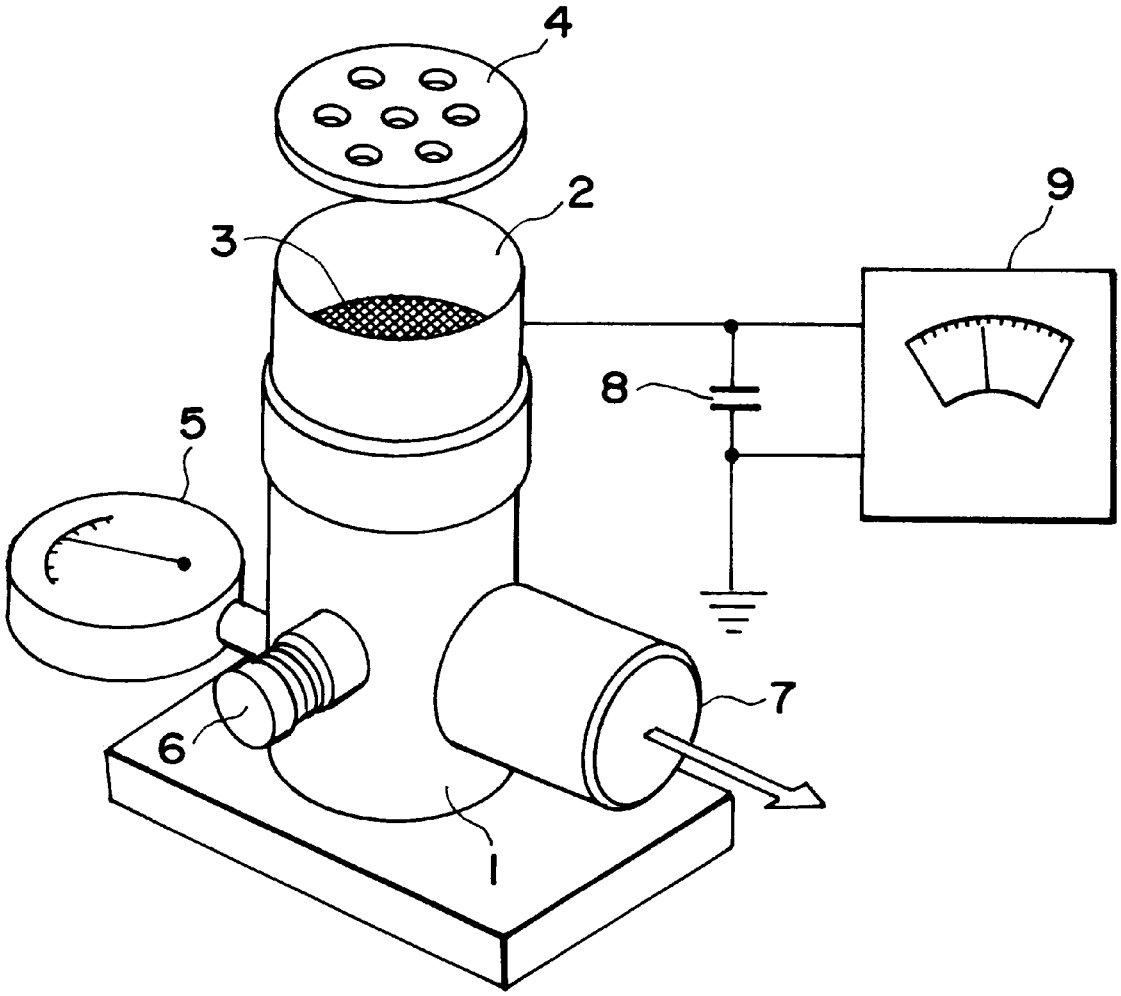
4
2
9
3
8
5
7
6
1

TONER FOR DEVELOPING ELECTROSTATIC IMAGES

FIELD OF THE INVENTION AND RELATED ART

The present invention relates to a toner for developing electrostatic (latent) images in image forming methods, such as electrophotography and electrostatic recording.

A toner is required to have a positive or a negative charge depending on the polarity of an electrostatic image developed therewith.

In order to provide a charge to a toner (i.e., charge the toner), it is possible to utilize the triboelectric chargeability of a resin per se as a toner component but, in this case, the toner is not provided with a stable chargeability so that it is difficult to obtain a sufficiently large image density at the very initial stage of startup of image formation and foggy images are liable to occur. For this reason, it has been a usual practice to add a charge control agent to provide a toner with a desired triboelectric chargeability.

Charge control agents known at present in the field of art include: negative charge control agents, such as metal complex salts of monoazo dyes, metal complexes of hydroxycarboxylic acids, dicarboxylic acids, aromatic diols, etc., and resins containing acid components; and positive charge control agents, such as nigrosin dyes, azine dyes, triphenylmethan-based dyes and pigments, quaternary ammonium salts, and polymers having a branch including a quaternary ammonium salt structure.

However, most of such known charge control agents are colored and not suitably used for color toners. On the other hand, colorless, white or only pale-colored charge control agents known heretofore are mostly insufficient in triboelectric chargeability-imparting performance. Thus, they are accompanied with difficulties such that they fail to provide a highlight uniformity or they result in a large fluctuation in image density during continuous image formation.

In addition to the above, some charge control agents involve other problems, such that it is difficult to obtain a good balance between image density and fog, it is difficult to obtain a sufficient image density in a high humidity environment, they show a poor dispersibility in resins, and they adversely affect the storage stability and fixability of the resultant toner.

Hitherto, several proposals have been made to use a phenol-aldehyde condensate as a charge control agent (e.g., in Japanese Laid-Open Patent Application (JP-A) 63-266462 and JP-A 2-201378). However, these publications have merely proposed the use of condensate mostly having a single number of condensation units or phenolic units.

More specifically, JP-A 63-266462 has disclosed phenol and a condensate having two phenolic units as a charge control agent. The JP-A reference fails to disclose the use of a mixture of condensates having different numbers of phenolic units. According to our study, it is generally difficult to disperse such a condensate having a single number of phenolic units in a resin.

JP-A 2-201378 discloses, as an example, calixarene having 4–8 units and contains a description to the following effect:

"When a calix[n]arene compound is synthesized through an ordinary synthesis process, a cyclic n-condensate and a mixture of acyclic products are produced. By isolating the objective cyclic compound, an objective calix[n]arene compound can be obtained. The acyclic products are oligomers of n=2–8 as represented by the following general formula. The compounds have different physical properties and structured from calixarene which is a white crystal to a white powder." (The general formula in the above is one similar to a general formula (IX) described hereinafter.)

Thus, according to JP-A 2-201378, the acyclic products have been removed as unnecessary to recover only a cyclic product, which is added to a toner. This is because an acyclic product is liable to contain impurities in various manner, which are likely to result in difficulties, such as an adverse influence to the chargeability.

A cyclic condensate has a high melting point and a low solubility in an organic solvent. Accordingly, a high chargeability can be obtained, but it is not necessarily easy to disperse such a cyclic condensate in a toner. Particularly, when a low-viscosity resin for a color toner is used, the dispersion is liable to be insufficient, thus leading to toner scattering in some cases.

On the other hand, JP-A 3-237467 discloses only a partial structure of condensate and does not refer to whether the condensate is cyclic or acyclic. However, the JP reference contains a description to the effect that "at least one species of p-phenylphenol-aldehyde condensate insoluble in tetrahydrofuran is contained", and thus aims at obtaining a high negative triboelectric chargeability by using a tetrahydrofuran-insoluble condensate.

SUMMARY OF THE INVENTION

An object of the present invention is to provide a toner for developing electrostatic images having a uniform chargeability.

Another object of the present invention is to provide a toner for developing electrostatic images capable of stably providing high image qualities even after being left standing in a low humidity environment or in a high humidity environment and not liable to cause toner scattering.

Another object of the present invention is to provide a toner for developing electrostatic images, which can be quicklyconsumed after replenishment, thus being little liable to result in deteriorated toner.

A further object of the present invention is to provide a toner for developing electrostatic images, capable of continually providing images faithful to latent images even in a long period of continuous image formation.

A still further object of the present invention is to provide a color toner having a good color reproducibility by using a colorless or only pale-colored charge control agent.

According to the present invention, there is provided a toner for developing electrostatic images, comprising: toner particles comprising a binder resin and a colorant, and inorganic fine powder, wherein the toner further contains: a phenol-aldehyde condensate mixture comprising an acyclic condensate and a cyclic condensate, respectively, of a phenol compound with an aldehyde compound, and the phenol-aldehyde condensate mixture contains 10–80 wt. % of condensate components having 4–6 phenolic units.

These and other objects, features and advantages of the present invention will become more apparent upon a consideration of the following description of the preferred embodiments of the present invention taken in conjunction with the accompanying drawing.

BRIEF DESCRIPTION OF THE DRAWING

A sole figure in the drawing is a schematic illustration of an apparatus for measuring a triboelectric chargeability of a toner.

DETAILED DESCRIPTION OF THE INVENTION

According to literature concerning calixarenes, a high-melting point substance different from phenol-formaldehyde resin known heretofore was found to be produced around 1940–1950. The substance has a cyclic structure and properties attributable to the structural characteristic, such as high melting point, high solvent resistance and negative chargeability.

Most of calixarenes proposed heretofore as a charge control agent are cyclic compounds having a single number of condensation or phenolic units. In contrast thereto, the phenol-aldehyde condensate mixture (as a charge control agent) according to the present invention is a mixture of a condensate having an acyclic condensate structure and a condensate having a cyclic condensate structure and include condensate components having different numbers of phenolic units. Herein, the term "phenolic unit" means a structural unit originated from a phenolic compound (in a sense of including phenol and a phenol derivative) as a condensation component. Further, the "number of phenolic units" refers to the number of phenolic units in a condensate component contained in the condensate mixture and is generally similar to the number of condensation units (each being a structural unit obtained from condensation of a phenolic compound with an aldehyde compound) of the condensation component in the condensate mixture, but in order to obviate a confusion arising from a possible lack of a structural portion originated from the aldehyde compound at a terminal of a condensate component, the number of phenolic units is used herein as an indication of the degree of condensation of a condensate component.

According to the present invention, an acyclic condensate which has not been generally used a charge control agent is included as an effective component of a charge control agent by controlling the structure thereof to be suitable for use in a toner.

Similarly as an ordinary thermoplastic resin, an acyclic condensate softens from a relatively low temperature and is in the form of a mixture including a low-molecular weight component having a low melting point. As such an acyclic condensate is mixed with a cyclic condensate, it is possible to obtain a good chargeability consequently. This may be attributable to the following phenomenon.

A cyclic condensate component exhibits a high chargeability but also shows agglomeratability, thus being liable to show inferior dispersibility. On the other hand, an acyclic condensate component does not have a high chargeability but readily softens to show good dispersibility. Further, the cyclic and acyclic condensate components have basically identical unit structures, so that they show a good affinity to each other and readily form a fine mixture state. Thus, the acyclic condensate component is assumed to function as a dispersion aid for the cyclic condensate component, to accomplish a uniformly high chargeability in combination.

Thus, by incorporating the specific phenol-aldehyde condensate mixture in a toner according to the present invention, it is possible to provide a toner capable of quickly obtaining a uniformly high charge distribution. As a result, even in a high temperature/high humidity environment liable to cause toner scattering, the toner scattering can be remarkably reduced by using the toner according to the present invention containing such a condensate mixture. Further, as the toner can quickly acquire a high charge, the replenished toner can be sequentially consumed without undue residence in the developing device.

The phenol-aldehyde condensate mixture used in the present invention may be produced by heating a phenolic compound and an aldehyde compound under an alkaline condition. Alternatively, it is also possible to once obtain an acyclic condensate and a cyclic condensate selectively and separately, and then mix the acyclic and cyclic condensates. The selective production may be obtained through adjustment of an alkaline metal addition condition and adjustment of the washing and extraction conditions for the condensation products. Examples of solvent suitably usable for the washing and extraction may include: acetone, methyl ethyl ketone, alcohols, ethers, hexane, dioxane, toluene, chloroform, tetrahydrofuran, and dimethylsulfoxide. These solvents may be used singly or in mixture of two or more species.

The phenol compound used in the present invention may be phenol; a phenol derivative obtained by replacing a hydrogen atom in the phenolic OH group of phenol with a substituent selected from an alkyl group, an aryl group, an aralkyl group and an acyl group; or phenol or such a phenol derivative as described above further having at its p-position a substituent selected from an alkyl group, an aralkyl group, an alicyclic group, an aryl group (optionally substituted with halogen, alkyl or fluoroalkyl), a fluoroalkyl group, a sulfon group, an amino group, or a silyl group. Preferred examples of the phenol compound may include: phenols, such as phenol, p-methylphenol, p-ethylphenol, p-propylphenol, p-i-butylphenol, p-pentylphenol, p-hexylphenol, p-heptylphenol, p-octylphenol, p-t-octylphenol, p-nonylphenol, p-decylphenol, p-cyclohexylphenol, p-cyclopentylphenol, p-phenylphenol, p-(4-chlorophenyl) phenol, p-(4-fluorophenol)phenol, p-cumylphenol, p-chlorophenol, p-fluorophenol, p-trifluoromethylphenol, p-perfluoroalkylphenol, p-benzylphenol, p-trimethylsilylphenol, p-nitrophenol, p-sulfophenol, and p-aminophenol. It is also possible to use phenol derivative obtained by subjecting the phenolic hydroxyl group in the above-mentioned phenols to alkylene, arylation, aralkylation or acylation.

Examples of the aldehyde compound may include: formaldehyde, acetaldehyde, propionaldehyde, benzaldehyde, butylaldehyde, valeroaldehyde, acrylaldehyde, salicylaldehyde, cinnamalaldehyde, p-tolualdehyde, p-chlorobenzaldehyde and anisaldehyde. Among these, formaldehyde, acetaldehyde and benzaldehyde are preferred.

Each of the acyclic and cyclic condensates may include structural units represented by the following formulae (I)–(III) (more specifically, at least one of (I) and (III), and (II)), and the acyclic condensate may have a terminal structural unit represented by the following formula (IV).

(I)

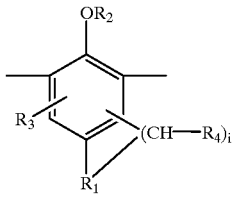

-continued (II)

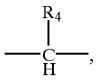

wherein i is 0 or 1;

if i is 0, $R_1$ is hydrogen atom, halogen atom, alkyl group, aryl group, aryl group having a substituent, aralkyl group, alicyclic group, alicyclic group having a substituent, fluoroalkyl group, nitro group, sulfonyl group, sulfonyl group having a substituent, amino group, amino group having a substituent, or trialkylsilyl group;

if i is 1, $R_1$ is alkylene group, arylene group, arylene group having a substituent, aralkylene group, alicylic group, alicyclic group having a substituent, imino group, imino group having a substituent or trialkylsilylene group;

$R_2$ is hydrogen atom, alkyl group, phenyl group, aralkyl group, —$COR_5$— ($R_5$ is hydrogen atom or alkyl group) or —$(CH_2)_mCOOR_6$ ($R_6$ is hydrogen atom or alkyl group, m is an integer of 1–3);

$R_3$ is hydrogen atom, alkyl group, halogen atom, carboxyl group, hydroxy group, cyano group, nitro group, halogenated alkyl group, trialkylsilyl group, an alkoxycarbonyl, aryloxycarbonyl or acyloxy group having 1–8 carbon atoms, amino group, amino group having a substituent, acyl group, sulfon group, sulfon group having a substituent, or an alkoxy or aryloxy group having 1–8 carbon atoms; and $R_4$ is hydrogen atom or alkyl group.

(III)

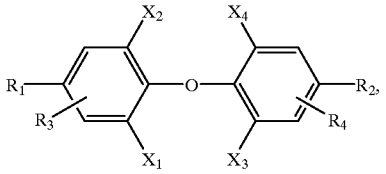

wherein $R_1$ and $R_2$ are independently hydrogen atom, halogen atom, alkyl group, aryl group, aryl group having a substituent, aralkyl group, alicyclic group, alicyclic group having a substituent, fluoroalkyl group, nitro group, sulfon group, sulfon group having a substituent, amino group, amino group having a substituent, or trialkylsilyl group;

$R_3$ and $R_4$ are independently hydrogen atom, alkyl group, halogen atom, carboxyl group, hydroxy group, cyano group, nitro group, halogenated alkyl group, trialkylsilyl group, an alkoxycarbonyl, aryloxycarbonyl or acyloxy group having 1–8 carbon atoms, amino group, amino group having a substituent, acyl group, sulfon group, sulfon group having a substituent, or an alkoxy or aryloxy group having 1–8 carbon atoms;

$X_1$, $X_2$, $X_3$ and $X_4$ denote bond positions capable of forming a ring with the unit of formula (I) or (III) via the unit of formula (II), and denote hydrogen atom, alkyl group or hydroxyalkyl group in the case of a terminal.

(IV)

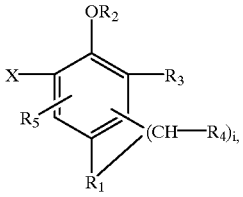

wherein i is 0 or 1;

if i is 0, $R_1$ denotes hydrogen atom, halogen atom, alkyl group, aryl group, aryl group having a substituent, aralkyl group, alicyclic group, alicyclic group having a substituent, fluoroalkyl group, nitro group, sulfonyl group, sulfonyl group having a substituent amino group, amino group having a substituent, or trialkylsilyl group;

if i is 1, $R_1$ is alkylene group, arylene group, arylene group having a substituent, aralkylene group, alicyclic group, alicyclic group having a substituent, imino group, imino group having a substituent, or trialkylsilylene group;

$R_2$ is hydrogen atom, alkyl group, phenyl group, aralkyl group, —$COR_6$— ($R_6$ is hydrogen atom or alkyl group) or —$(CH_2)_mCOOR_7$ ($R_7$ is hydrogen atom or alkyl group, m is an integer of 1–3);

$R_3$ and $R_4$ are hydrogen atom or alkyl group;

$R_5$ is hydrogen atom, alkyl group, halogen atom, carboxyl group, hydroxy group, cyano group, nitro group, halogenated alkyl group, trialkylsilyl group, an alkoxycarbonyl, aryloxycarbonyl or acyloxy group having 1–8 carbon atoms, amino group, amino group having a substituent, acyl group, sulfon group, sulfone group having a substituent or an alkoxy or aryloxy group having 1–8 carbon atoms; and X denotes a bond position and is bonded to the unit of formula (I) or (III) via the unit of formula (II).

Examples of the substituents $R_n$ in the above-mentioned formulae (I)–(IV) are respectively enumerated above and are usable if they do not hinder the condensation reaction. In many cases, it is preferred that the substituents are electron-donative group.

A preferred class of examples of the acyclic and cyclic condensates may include structural units represented by the following formulae (V)–(VII), and the cyclic condensates may have a terminal structural unit represented by a formula (VIII) shown below.

(V)

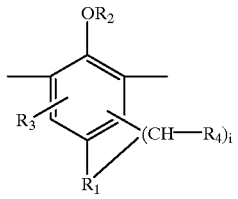

(VI)

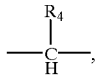

wherein i is 0 or 1;

if i is 0, $R_1$ is alkyl group, aralkyl group, alicyclic group, fluoroalkyl group, aryl group, or aryl group having a substituent selected from halogen atom, alkyl group and fluoroalkyl group;

if i is 1, $R_1$ is alkylene group, aralkylene group, alicyclic group, fluoroalkylene group, arylene group, or arylene group having a substituent;

$R_2$ is hydrogen atom or alkyl group;

$R_3$ is hydrogen atom, alkyl group, halogen atom or nitro group; and $R_4$ is hydrogen atom or alkyl group.

(VII)

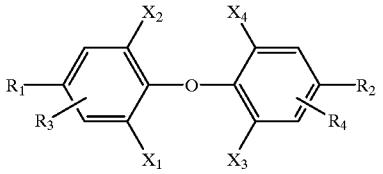

wherein $R_1$ and $R_2$ are independently alkyl group, aralkyl group, alicyclic group, fluoroalkyl group, aryl group or aryl group having a substituent;

$R_3$ and $R_4$ are independently hydrogen atom or alkyl group; and $X_1$, $X_2$, $X_3$ and $X_4$ denote bond positions capable of forming a ring with the unit of formula (V) or (VII) via the unit of formula (VI), and denote hydrogen atom, alkyl group or hydroxyalkyl group in the case of a terminal.

(VIII)

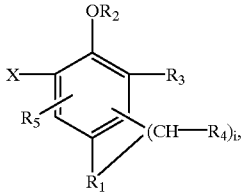

wherein $R_1$ is alkyl group, aralkyl group, alicyclic group, fluoroalkyl group, aryl group or aryl group having a substituent selected from halogen atom, alkyl group and fluoroalkyl group;

$R_2$, $R_3$ and $R_4$ are independently hydrogen atom or alkyl group; and

X denotes a bond position and is bonded to the unit of (V) or (VII) via the unit of formula (VI).

It is further preferred that, in the formulae (I)–(VIII), the alkyl group, alicyclic group and fluoroalkyl group have at most 10 carbon atoms; the aryl group, and aralkyl group have at most 12 carbon atoms; and particularly the alkyl group and fluoroalkyl group have at most 3 carbon atoms.

Some more description will be made while taking the case of i=0 in the unit of formula (I) for example. In case where the substituent $R_1$ in formula (I) is alkyl group, aryl group, aralkyl group or alicyclic group capable of having a substituent, a high chargeability and a quick charging performance may be imparted. Among these, it is preferred to use optionally substituted phenyl group, cumyl group, cyclohexyl group or methyl group in order to provide a good charge retaining performance. Methyl group, phenyl group and cyclohexyl group are preferred also in respect of not adversely affecting the fixability of the resultant toner.

It is further preferred to introduce phenyl group by using p-phenylphenol as a starting phenol in view of easiness of synthesis.

$R_2$ in formula (I) is most preferably hydrogen atom but alkyl group and aralkyl group are also preferred.

$R_3$ in formula (I) most preferably hydrogen atom, but alkyl group, halogen atom and nitro group are also preferred in view of chargeability enhancing effect.

$R_4$ in formula (I) is most preferably hydrogen atom but methyl group is also preferred because it does not binder the condensation reaction and it is little liable to result in impurities adversely affecting the toner performances.

It is also preferred to use a condensate mixture including two or more different species of phenolic units by use of different groups for at least one of $R_1$, $R_2$, $R_3$ and $R_4$. By including two or more different species of phenolic units, the resultant condensate mixture powder is provided with less crystallinity, thereby allowing adjustment of dispersibility in the toner and quick chargeability characteristic. Preferred examples of combination of different groups $R_1$ (i=0) may include a combination of phenyl group and cyclohexyl group, and a combination of a phenyl group and a methyl group.

Some literature frequently discloses an acyclic condensate as represented by formula (IX) shown below having an alcoholic OH group at both ends.

(IX)

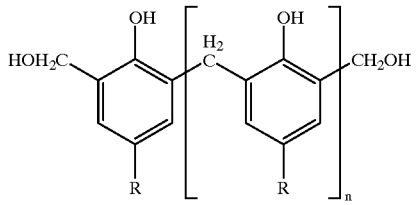

Such an acyclic condensate having alcoholic OH terminals can adversely affect the chargeability in a high humidity environment, and acyclic condensates having hydrogen terminals or alkyl terminals as represented by formula (X) or (XI) shown below are preferred in the present invention.

(X)

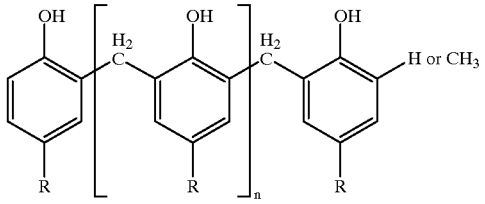

(XI)

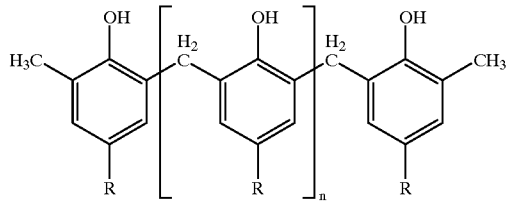

In the condensate mixture of the present invention, the acyclic condensate and the cyclic condensate may preferably be contained in a mol ratio of 1:20–30:1, more preferably 1:10–20:1. If the acyclic condensate content is less than 1:20, the dispersion-improving effect can be attained only in a limited composition. If the acyclic condensate content is less than 1:10, it becomes difficult to obtain a sufficient effect when the condensate mixture is dispersed in a soft binder suitable for a color toner. By containing the acyclic condensate in a mol ratio of at least 1:20, it becomes possible to quickly reach a charge level suitable for development and the toner supplied to the developing device can quickly exchange the already present toner and can be consumed quickly. In case of a ratio of at least 1:10, quick exchange particularly in a low humidity environment can be accomplished. As a result, the deterioration of toner can be prevented to provide an improved image quality during continuous image formation. Further, the occurrence of excessively charged toner (so-called "charge-up phenomenon") can be reduced to provide a stable image density.

On the other hand, if the cyclic condensate is less than the mol ratio of 30:1, only a limited toner composition is allowed in the case of requiring a high chargeability. If the cyclic condensate is less than the mol ratio of 20:1, it becomes difficult to apply the cyclic condensate to a magnetic toner having a small particle size.

In evaluation of the acyclic to cyclic mol ratio, a condensate having one phenolic unit is included in the acyclic condensate.

The condensate mixture according to the present invention may preferably contain 10–80 mol %, more preferably 20–70 mol % of condensate component having 1–3 phenolic units.

If the condensate components having 1–3 phenolic units are contained in at least 10 mol %, the dispersibility of the condensate mixture begins to be remarkably increased. If the content is at least 20 mol %, the dispersibility is improved also in a resin for color toner. On the other hand, if the content exceeds 70 mol %, the storage stability of the resultant toner can be adversely affected in some cases and, in excess of 80 mol %, it becomes difficult to find out an appropriate amount of the condensate mixture to be added to the toner.

The condensate mixture according to the present invention may contain 10–80 mol %, preferably 20–70 mol %, of condensate components having 4–6 phenolic units. If the condensate components having 4–6 phenolic units are contained in at least 10 mol %, the dispersibility of the condensate mixture is improved and the toner exchange rate can be increased. If the content is at least 20 mol %, the effect can be exhibited also in a magnetic toner. In excess of 80 mol %, the dispersibility begins to be rather lowered.

Each condensate component can comprise identical phenolic unit species or different phenolic unit species. The number of phenolic units is of course given as the total number of phenolic units even if different phenolic unit species are contained in a single condensate component.

It is preferred that the acyclic condensate and the cyclic condensate used in the present invention comprise at least one species of condensation product between p-phenyl phenol or a p-alkylphenol including a p-alkyl substituent having at most 10 carbon atoms and formaldehyde or acetaldehyde.

Hereinbelow, some specific structure examples of condensate mixtures and condensate components are enumerated.

First, acyclic condensates and cyclic condensates are respectively enumerated below.

<Examples of Acyclic Condensates>

(C-1) An acyclic condensate mixture of acyclic condensate components each having at least one phenolic unit species selected from the following four phenolic unit species (A)–(D). In a condensate component having a total number of phenolic units (=A+B+C+D) of 2 or larger, each pair of adjacent phenolic units are bonded with an intervening methylene (—$CH_2$—) group.

(A)

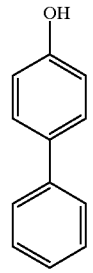

(B)

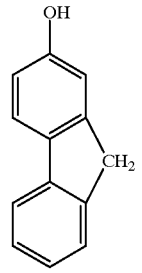

(C)

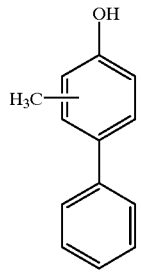

(D)

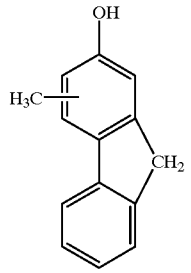

Such an acyclic condensate component may be produced by using p-phenylphenol (A) and formaldehyde in a mixture ratio of 1:2.0 (by mol) as starting materials.

A specific example of condensate component (case of A:B:C:D=3:0:0:0 in Table 1 below) may be represented by the following formula:

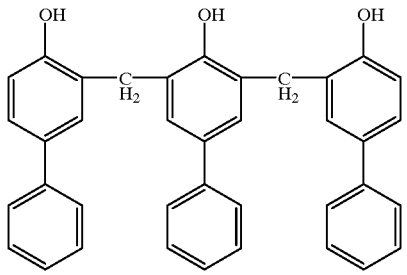

An example table of contents for the respective condensate components is given as Table 1 below.

TABLE 1

| A | B | C | D | A + B + C + D | content (by mol) |
|---|---|---|---|---|---|
| 1 | 0 | 0 | 0 | 1 | 6% |
| 0 | 1 | 0 | 0 | 1 | 7% |
| 0 | 0 | 1 | 0 | 1 | 4% |
| 0 | 0 | 0 | 1 | 1 | 2% |
| 2 | 0 | 0 | 0 | 2 | 10% |
| 1 | 1 | 0 | 0 | 2 | 8% |
| 1 | 0 | 1 | 0 | 2 | 3% |
| 0 | 1 | 1 | 0 | 2 | 3% |
| 3 | 0 | 0 | 0 | 3 | 15% |
| 2 | 1 | 0 | 0 | 3 | 7% |
| 2 | 0 | 1 | 0 | 3 | 6% |
| 2 | 0 | 0 | 1 | 3 | 1% |
| 4 | 0 | 0 | 0 | 4 | 8% |
| 3 | 1 | 0 | 0 | 4 | 4% |
| 3 | 0 | 1 | 0 | 4 | 2% |
| 5 | 0 | 0 | 0 | 5 | 5% |
| 4 | 1 | 0 | 0 | 5 | 2% |
| 4 | 0 | 1 | 0 | 5 | 2% |
| 6 | 0 | 0 | 0 | 6 | 3% |
| 5 | 1 | 0 | 0 | 6 | 1% |
| 5 | 0 | 1 | 0 | 6 | 1% |

The contents of the respective condensate components shown herein (e.g., as shown in the above Table 1) are based on values measured in the following manner.

The molecular weight distribution of a sample condensate mixture is measured according to an FD-MS (field desorption-mass spectroscopy) apparatus ("M-80B", available from Hitachi Seisakusho K.K.). On the other hand, the molecular weight of each phenolic unit is calculated as indicated below.

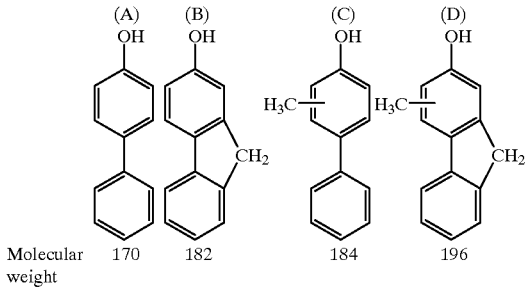

From the FD-MS data, a measured value M/Z is denoted by α, and the phenolic units (A), (B), (C) and (D) are assumed to be contained in numbers of k, l, m and n, respectively, in a condensate component, the value α for the condensate component is calculated according to the following evaluation:

$$\alpha=(170+12)\times k+(182+12)\times 1+(184+12)\times m+(196+12)\times n-12$$

If a certain condensate component is represented by M/Z=548, given by a calculation of 128×2+196−12=548, M/Z=548 represents that the condensate component includes two phenolic units (A) and one phenolic unit (C), thus giving A:B:C:D=2:0:1:0. The contents of the respective condensate components may be obtained from the respective peak intensity ratios at respective M/Z values.

Other examples of acyclic condensate mixtures are shown below.

(C-2) An acyclic condensate mixture of acyclic condensate components each having at least one phenolic unit species selected from the following five phenolic unit species (A)–(E). Each pair of adjacent phenolic units are bonded with an intervening methylene (—$CH_2$—) group.

(A)

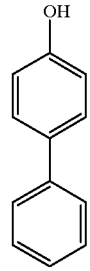

(B)

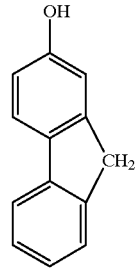

(C)

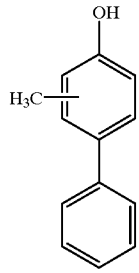

(D)

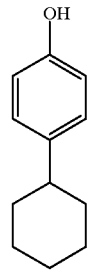

-continued (E)

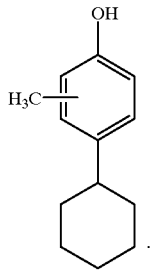

The condensate mixture may be produced by using A:D:formaldehyde in mol ratios of 1:1:3.5 as starting materials.

The condensate mixture contains the condensate components as represented by numbers of phenolic units in proportions shown in the following Table 2.

TABLE 2

| Number of phenolic units | Total content (mol) |
|---|---|
| 1 | 8% |
| 2 | 12% |
| 3 | 19% |
| 4 | 23% |
| 5 | 16% |
| 6 | 11% |
| 7 | 8% |
| 8 | 3% |

An example of condensate components having 4 phenolic units is represented by the following structural formula:

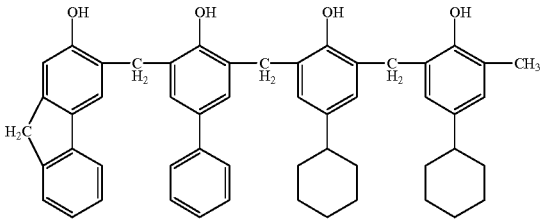

(C-3) An acyclic condensate mixture of acyclic condensate components each having at least one phenolic unit species selected from the following five phenolic unit species (A)–(E). Each pair of adjacent phenolic units are bonded with an intervening methylene (—$CH_2$—) group.

(A)

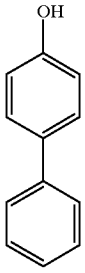

-continued (B)

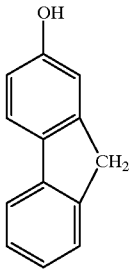

(C)

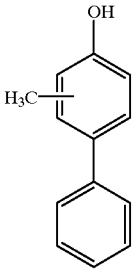

(D)

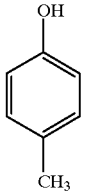

(E)

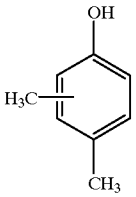

The condensate mixture may be produced by using A:D:formaldehyde in mol ratios of 1:1:3.8 as starting materials.

The condensate mixture contains the condensate components as represented by numbers of phenolic units in proportions shown in the following Table 3.

TABLE 3

| Number of phenolic units | Total content (mol) |
|---|---|
| 1 | 3% |
| 2 | 6% |
| 3 | 9% |
| 4 | 14% |
| 5 | 18% |
| 6 | 20% |
| 7 | 14% |
| 8 | 9% |
| ≧9 | 7% |

(C-4) An acyclic condensate mixture of acyclic condensate components each having at least one phenolic unit species selected from the following four phenolic unit species (A)–(D). Each pair of adjacent phenolic units are bonded with an intervening methylene (—$CH_2$—) group.

(A)

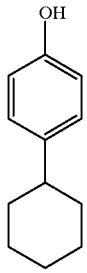

(B)

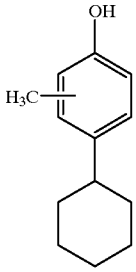

(C)

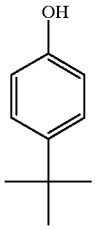

(D)

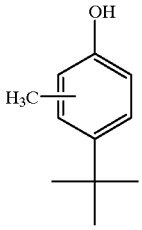

The condensate mixture may be produced by using A:D:formaldehyde in mol ratios of 2:1:5.7 as starting materials.

The condensate mixture contains the condensate components as represented by numbers of phenolic units in proportions shown in the following Table 4.

TABLE 4

| Number of phenolic units | Total content (mol) |
|---|---|
| 1 | 7% |
| 2 | 13% |
| 3 | 20% |
| 4 | 18% |
| 5 | 17% |
| 6 | 14% |
| 7 | 8% |
| 8 | 3% |

(C-5) An acyclic condensate mixture of acyclic condensate components each having at least one phenolic unit species selected from the following six phenolic unit species (A)–(F). Each pair of adjacent phenolic units are bonded with an intervening methylene (—$CH_2$—) group.

(A)

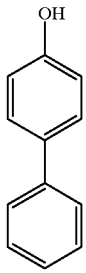

(B)

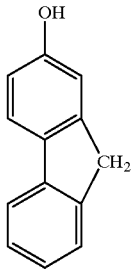

(C)

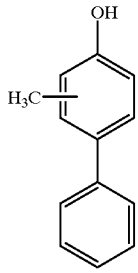

(D)

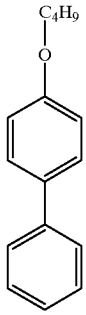

(E)

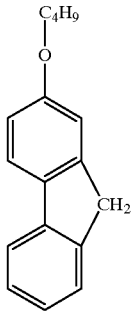

-continued (F)

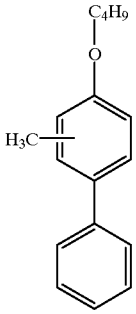

The condensate mixture may be produced by using A:formaldehyde in a mol ratio of 1:2 as starting materials and alkylating hydroxyl groups with butyl iodide after the condensation.

The condensate mixture contains the condensate components as represented by numbers of phenolic units in proportions shown in the following

TABLE 5

| Number of phenolic units | Total content (mol) |
|---|---|
| 1 | 18% |
| 2 | 23% |
| 3 | 26% |
| 4 | 18% |
| 5 | 10% |
| 6 | 5% |

(C-6) An acyclic condensate mixture of acyclic condensate components each having at least one phenolic unit species selected from the following four phenolic unit species (A)–(D). Each pair of adjacent phenolic units are bonded with an intervening methylene (—$CH_2$—) group.

(A)

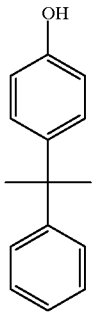

-continued (B)

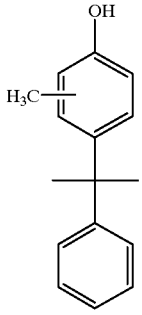

(C)

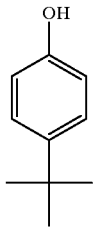

(D)

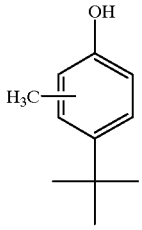

The condensate mixture may be produced by using A:C:formaldehyde in mol ratios of 1:1:3.6 as starting materials.

The condensate mixture contains the condensate components as represented by numbers of phenolic units in proportions shown in the following Table 6.

TABLE 6

| Number of phenolic units | Total content (mol) |
|---|---|
| 1 | 2% |
| 2 | 8% |
| 3 | 17% |
| 4 | 35% |
| 5 | 29% |
| 6 | 9% |

(C-7) An acyclic condensate mixture of acyclic condensate components each having at least one phenolic unit species selected from the following two phenolic unit species (A) and (B). Each pair of adjacent phenolic units are bonded with an intervening —$CH_2$— or —$CH(CH_3)$— group.

(A)

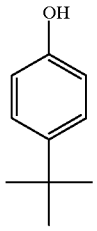

(B)

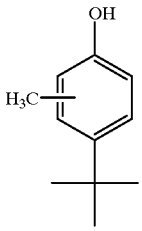

The condensate mixture may be produced by using A:formaldehyde:acetaldehyde in mol ratios of 1:1:1.

The condensate mixture contains the condensate components as represented by numbers of phenolic units in proportions shown in the following Table 7.

TABLE 7

| Number of phenolic units | Total content (mol) |
|---|---|
| 1 | 3% |
| 2 | 5% |
| 3 | 9% |
| 4 | 16% |
| 5 | 22% |
| 6 | 23% |
| 7 | 17% |
| 8 | 5% |

(C-8) An acyclic condensate mixture of acyclic condensate components each having at least one phenolic unit species selected from the following four phenolic unit species (A)–(D). Each pair of adjacent phenolic units are bonded with an intervening methylene (—$CH_2$—) group.

(A)

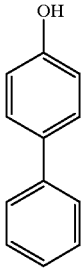

-continued (B)

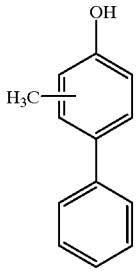

(C)

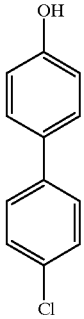

(D)

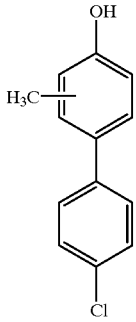

The condensate mixture may be produced by using A:C:formaldehyde in mol ratios of 1:1:3.6 as starting materials.

The condensate mixture contains the condensate components as represented by numbers of phenolic units in proportions shown in the following Table 8.

TABLE 8 ?

| Number of phenolic units | Total content (mol) |
|---|---|
| 1 | 2% |
| 2 | 5% |
| 3 | 10% |
| 4 | 13% |
| 5 | 19% |
| 6 | 20% |
| 7 | 13% |
| 8 | 9% |
| 9 | 6% |
| ≧10 | 3% |

(C-9) An acyclic condensate mixture of acyclic condensate components each having at least one phenolic unit species selected from the following four phenolic unit species (A)–(D). Each pair of adjacent phenolic units are bonded with an intervening methylene (—$CH_2$—) group.

(A)

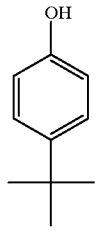

(B)

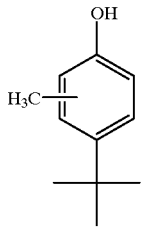

(C)

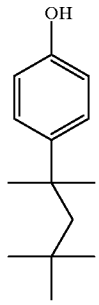

(D)

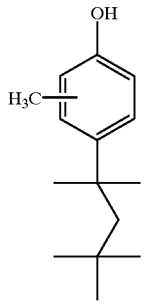

The condensate mixture may be produced by using A:C:formaldehyde in mol ratios of 1:1:3.8 as starting materials.

The condensate mixture contains the condensate components as represented by numbers of phenolic units in proportions shown in the following Table 9.

TABLE 9

| Number of phenolic units | Total content (mol) |
|---|---|
| 1 | 8% |
| 2 | 14% |
| 3 | 23% |
| 4 | 21% |
| 5 | 17% |
| 6 | 11% |
| 7 | 4% |
| 8 | 2% |

(C-10) An acyclic condensate mixture of acyclic condensate components each having at least one phenolic unit species selected from the following four phenolic unit species (A)–(D), of which (D) has two phenolic units. Each pair of adjacent phenolic unit species are bonded with an intervening methylene (—$CH_2$—) group.

(A)

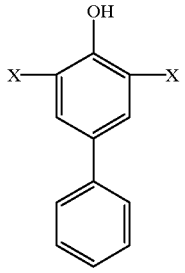

(B)

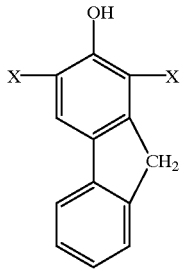

(C)

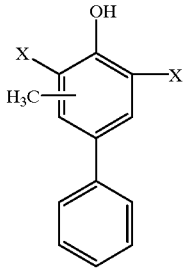

(D)

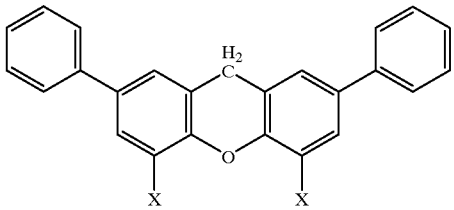

wherein X denotes a bond position, or a hydrogen atom or a methyl group at a terminal.

The condensate mixture may be produced by using A (X is hydrogen):formaldehyde in a mol ratio of 1:1.7 as starting materials.

The condensate mixture contains the condensate components as represented by numbers of phenolic units in proportions shown in the following Table 10.

TABLE 10

| Number of phenolic units | Total content (mol) |
|---|---|
| 1 | 4% |
| 2 | 12% |
| 3 | 19% |
| 4 | 28% |
| 5 | 21% |
| 6 | 16% |

(C-11) An acyclic condensate mixture of acyclic condensate components each having at least one phenolic unit species selected from the following two phenolic unit species (A) and (B). Each pair of adjacent phenolic units are bonded with an intervening methylene (—$CH_2$—) group.

(A)

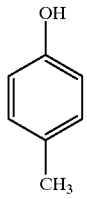

(B)

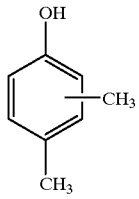

The condensate mixture may be produced by using A:formaldehyde in a mol ratio of 1:1.8 as starting materials.

The condensate mixture contains the condensate components as represented by numbers of phenolic units in proportions shown in the following Table 11.

TABLE 11

| Number of phenolic units | Total content (mol) |
|---|---|
| 1 | 3% |
| 2 | 7% |
| 3 | 14% |
| 4 | 16% |
| 5 | 18% |
| 6 | 20% |
| 7 | 14% |
| 8 | 8% |

<Examples of Cyclic Condensate>

(R-1) A cyclic condensate mixture of cyclic condensate components each having phenolic unit species (A) shown below. Each pair of adjacent phenolic units are bonded with an intervening methylene (—$CH_2$—) group.

(A)

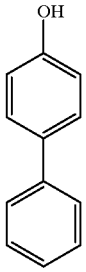

A condensate component having 4 phenolic units, for example, is represented by the following structural formula:

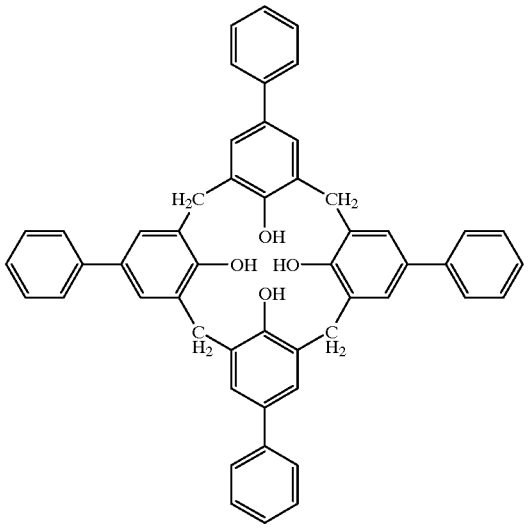

The condensate mixture may be formed through a reaction of A and formaldehyde in a ratio of 1:1.8 as starting materials.

The condensate mixture contains the condensate components as represented by the number of phenolic units in proportions shown in the following Table 12.

TABLE 12

| Number of phenolic units | Total content (mol) |
|---|---|
| 4 | 48% |
| 5 | 43% |
| 6 | 9% |

(R-2) A cyclic condensate mixture of cyclic condensate components each having at least one phenolic unit species selected from the following two phenolic unit species (A) and (B) shown below. Each pair of adjacent phenolic units are bonded with an intervening methylene (—$CH_2$—) group.

(A)

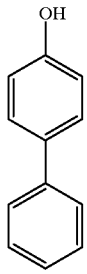

(B)

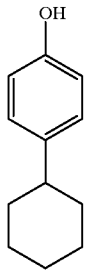

A condensate component having 4 phenolic units, for example, is represented by the following structural formula:

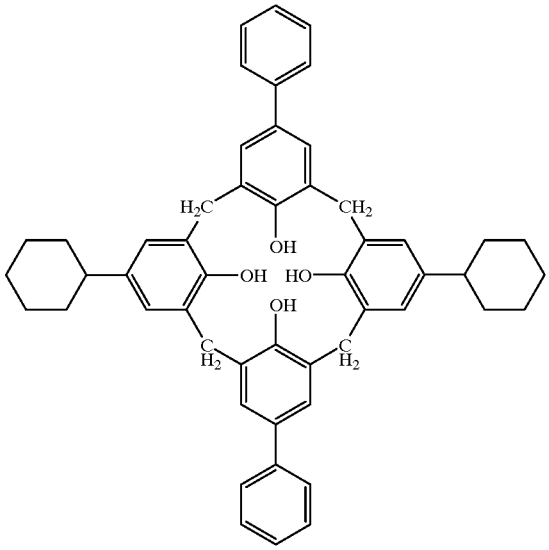

The condensate mixture may be formed through a reaction of A, B and formaldehyde in mol ratios of 1:1:3.6 as starting materials.

The condensate mixture contains the condensate components as represented by the number of phenolic units in proportions shown in the following Table 13.

TABLE 13

| Number of phenolic units | Total content (mol) |
|---|---|
| 4 | 32% |
| 5 | 6% |
| 6 | 5% |
| 7 | 6% |

TABLE 13-continued

| Number of phenolic units | Total content (mol) |
|---|---|
| 8 | 51% |

(R-3) A cyclic condensate mixture of cyclic condensate components each having at least one phenolic unit species selected from the following two phenolic unit species (A) and (B) shown below. Each pair of adjacent phenolic units in a cyclic condensate component are bonded with an intervening methylene (—$CH_2$—) group.

(A)

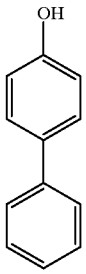

(B)

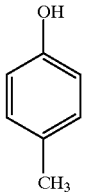

The condensate mixture may be formed through a reaction of A, B and formaldehyde in mol ratios of 1:1:3.5.

The condensate mixture contains the condensate components as represented by the number of phenolic units in proportions shown in the following Table 14.

TABLE 14

| Number of phenolic units | Total content (mol) |
|---|---|
| 4 | 18% |
| 8 | 82% |

(R-4) A cyclic condensate mixture of cyclic condensate components each having at least one phenolic unit species selected from the following two phenolic unit species (A) and (B) shown below. Each pair of adjacent phenolic units in a cyclic condensate component are bonded with an intervening methylene (—$CH_2$—) group.

(A)

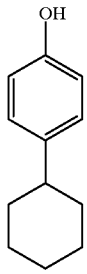

(B)

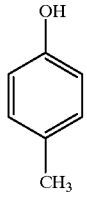

The condensate mixture may be formed through a reaction of A, B and formaldehyde in mol ratios of 1:1:3.7.

The condensate mixture contains the condensate components as represented by the number of phenolic units in proportions shown in the following Table 15.

TABLE 15

| Number of phenolic units | Total content (mol) |
|---|---|
| 4 | 53% |
| 8 | 47% |

(R-5) A cyclic condensate mixture of cyclic condensate components each having at least one phenolic unit species selected from the following two phenolic unit species (A) and (B) shown below, of which (B) includes two phenolic units. Each pair of adjacent phenolic units in a cyclic condensate component are bonded with an intervening methylene (—$CH_2$—) group.

(A)

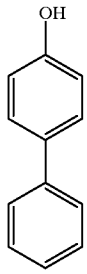

(B)

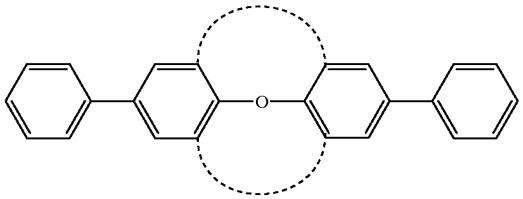

wherein a dashed line represents a ring formed of a phenolic unit and/or a methylene group.

The condensate mixture may be formed through a reaction of A and formaldehyde in a mol ratio of 1:1.7.

The condensate mixture contains the condensate components as represented by the number of phenolic units in proportions shown in the following Table 16.

TABLE 16

| Number of phenolic units | Total content (mol) |
|---|---|
| 4 | 63% |
| 6 | 21% |
| 8 | 16% |

(R-6) A cyclic condensate mixture of cyclic condensate components each having at least one phenolic unit species selected from the following two phenolic unit species (A) and (B) shown below. Each pair of adjacent phenolic units in a cyclic condensate component are bonded with an intervening methylene (—$CH_2$—) group.

(A)

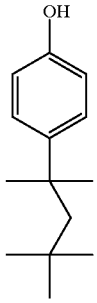

(B)

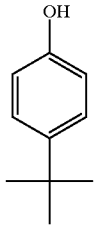

The condensate mixture may be formed through a reaction of A, B and formaldehyde in mol ratios of 1:1:3.7.

The condensate mixture contains the condensate components as represented by the number of phenolic units in proportions shown in the following Table 17.

TABLE 17

| Number of phenolic units | Total content (mol) |
|---|---|
| 4 | 28% |
| 5 | 4% |
| 6 | 15% |
| 7 | 5% |
| 8 | 48% |

(R-7) A cyclic condensate mixture of cyclic condensate components each having phenolic unit species (A) shown below. Each pair of adjacent phenolic units in a cyclic condensate component are bonded with an intervening methylene (—$CH_2$—) group.

(A)

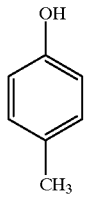

The condensate mixture may be formed through a reaction of A and formaldehyde in a ratio of 1:1.7.

The condensate mixture contains the condensate components as represented by the number of phenolic units in proportions shown in the following Table 18.

TABLE 18

| Number of phenolic units | Total content (mol) |
|---|---|
| 4 | 2% |
| 5 | 6% |
| 6 | 51% |
| 7 | 18% |
| 8 | 23% |

<Examples of Acyclic/Cyclic Condensate Mixture>

The following acyclic/cyclic condensate mixtures (1)–(7) were respectively obtained by mixing an acyclic condensate (mixture) and a cyclic condensate (mixture) which were separately isolated from a relevant condensation reaction system in solution in acetone or ethyl acetate.

Acyclic/Cyclic Condensate Mixture (1)

A mixture of Acyclic condensate mixture (C-1) and Cyclic condensate mixture (R-1) having compositions as described above in a ratio of 70/30. The mixture was obtained in the form of a powder having a number-average particle size ($D_1$) of 2.8 $\mu$m.

An overall content of condensate components having 1–4 phenolic units (denoted by $PU_{1-3}$ content) is 50.4 mol %, and an overall content of condensate components having 4–6 phenolic units (denoted by $PU_{4-6}$ content) is 49.6 mol %, respectively in the resultant mixture.

Acyclic/Cyclic Condensate Mixture (2)

A mixture of Acyclic condensate mixture (C-2) and Cyclic condensate mixture (R-2) in a mol ratio of 4/96.

$D_1$=2.9 $\mu$m.

$PU_{1-3}$ content=1.6 mol %.

$PU_{4-6}$ content=43.3 mol %.

Acyclic/Cyclic Condensate Mixture (3)

A mixture of Acyclic condensate mixture (C-2) and Cyclic condensate mixture (R-2) in a mol ratio of 97/3.

$D_1$=3.2 $\mu$m.

$PU_{1-3}$ content=37.8 mol %.

$PU_{4-6}$ content=49.8 mol %.

Acyclic/Cyclic Condensate Mixture (4)

A mixture of Acyclic condensate mixture (C-3) and Cyclic condensate mixture (R-3) in a mol ratio of 40/60.

$D_1$=2.9 $\mu$m.

$PU_{1-3}$ content=7.2 mol %.

$PU_{4-6}$ content=31.6 mol %.

Acyclic/Cyclic Condensate Mixture (5)

A mixture of Acyclic condensate mixture (C-1) and phenyl-calix[8]arene (i.e., 100% of a cyclic condensate component having 8 phenolic units) in a mol ratio of 30/70.

$D_1$=3.2 $\mu$m.

$PU_{1-3}$ content=21.6 mol %.

$PU_{4-6}$ content=48.4 mol %.

Acyclic/Cyclic Condensate Mixture (6)

A mixture of Acyclic condensate mixture (C-4) and Cyclic condensate mixture (R-4) in a mol ratio of 50/50.

$D_1$=3.1 $\mu$m.

$PU_{1-3}$ content=20 mol %.

$PU_{4-6}$ content=51 mol %.

Acyclic/Cyclic Condensate Mixture (7)

A mixture of Acyclic condensate mixture (C-9-2) and Cyclic condensate mixture (R-6-2) in a mol ratio of 50/50.

$D_1$=3.0 $\mu$m.

$PU_{13}$ content=21.5 mol %.

$PU_{4-6}$ content=35 mol %.

** Acyclic condensate mixture (C-9-2) is similar in composition as Acyclic condensate mixture (C-9) except that the condensate component distribution is changed as follows.

TABLE 19

| Number of phenolic units | Total content (mol) |
|---|---|
| 1 | 8% |
| 2 | 14% |
| 3 | 21% |
| 4 | 19% |
| 5 | 17% |
| 6 | 12% |
| 7 | 6% |
| 8 | 3% |

Cyclic condensate mixture (R-6-2) is similar in composition as Cyclic condensate mixture (R-6) except that condensate component distribution is changed as follows.

TABLE 20

| Number of phenolic units | Total content (mol) |
|---|---|
| 4 | 22% |
| 8 | 78% |

Acyclic/Cyclic Condensate Mixture (8)

A condensate mixture prepared in the following manner.

During the synthesis of Acyclic condensate mixture (C-1), formaldehyde and a catalyst used for the synthesis of Cyclic condensate mixture (R-1) are added to form Acyclic/cyclic condensate mixture (8).

As a result of analysis, Acyclic/cyclic condensate mixture (8) contains condensate components identical to those in the condensate mixtures (C-1) and (R-1), and exhibits the following data.

Acyclic condensate/cyclic condensate ratio =73/27 (by mol)

$D_1$=3.1 $\mu$m.

$PU_{1-3}$ content=57 mol %.

$PU_{4-6}$ content=43 mol %.

Acyclic/Cyclic Condensate Mixture (9)

A mixture of Acyclic condensate mixture (C-5) and Cyclic condensate mixture (R-1) in a mol ratio of 25/75.

$D_1$=3.0 $\mu$m.

$PU_{1-3}$ content=16.8 mol %.

$PU_{4-6}$ content=76.5 mol %.

The phenol-aldehyde condensate mixture according to the present invention may be produced in the form of powder and incorporated in the toner either by the incorporation thereof in colored resin particles (i.e., toner particles) (internal addition) or externally blended with toner particles (external addition). In the case of internal addition, the condensate mixture may preferably be added in 0.1–10 wt. parts, more preferably 0.5–5 wt. parts, per 100 wt. parts of the binder resin. In the case of external addition, the condensate mixture may preferably be added in 0.01–5 wt. parts per 100 wt. parts of the toner particles, and may preferably be affixed mechano-chemically onto the surface of toner particles.

The phenol-aldehyde condensate mixture may preferably have a number-average particle size of 1–5 $\mu$m in a state before toner preparation, but are present at a smaller particle size in or on toner particles due to comminution during a process of incorporation into toner particles or external blending with toner particles.

The phenol-aldehyde condensate mixture according to the present invention can be used in combination with a conventional charge control agent as described hereinbefore.

The toner particles (colored resin particles) may be blended with inorganic fine powder externally added thereto. The inorganic fine powder may preferably comprise an inorganic oxide, such as silica, alumina or titanium oxide, or carbon black, or fluorinated carbon, e.g., because of easiness of providing particles of small particle sizes.

A high flowability-improving effect is exhibit if silica, alumina or titanium oxide is dispersed in fine particles on the toner particle surface. It is preferred to have an average particle size of 2–200 nm, further preferably 5–80 nm. The inorganic fine powder, such as silica, may preferably have a BET specific surface (i.e., a specific surface area as measured by nitrogen adsorption according to the BET method) of at least 30 $m^2/g$, particularly 40–400 $m^2/g$, before surface treatment for hydrophobization, and at least 20 $m^2/g$, particularly 40–300 $m^2/g$, after such surface treatment.

The inorganic fine powder may preferably be added in a proportion of 0.03–5 wt. % of the toner particles, so as to provide an appropriate surface-covering rate.

The inorganic fine powder may preferably have a hydrophobicity of at least 30%. The hydrophobization agent may preferably comprise a silicon-containing surface-treating agent, such as silane compounds and silicone oil.

Examples of the silane compounds may include: alkylalkoxysilanes, such as dimethyldimethoxysilane, trimethylethoxysilane, and butyltrimethoxysilane; and other silane compounds, such as dimethyldichloro-silane, trimethylchlorosilane, allyldimethylchloro-silane, hexamethyldisilazane, allylphenyldichloro-silane, benzyldimethylchlorosilane, vinyltriethoxy-silane, γ-methacryloxypropyltrimethoxy-silane, vinyltriacetoxysilane, divinyldichlorosilane, and dimethylvinylchlorosilane.

It is also possible to use a positive chargeability-imparting surface-treating agent in order to adjust a chargeability, etc. Examples thereof may include: silane coupling agents, such as aminopropyltrimethoxysilane, aminopropyltriethoxysilane, dimethylaminopropyltrimethoxysilane, diethylaminopropyltrimethoxysilane, dipropylaminopropyltrimethoxysilane and dibutylaminopropyltrimethoxysilane; and amino-modified silicone oil.

The toner particles generally comprise a binder resin, examples of which may include: styrene resin, styrene copolymer resin, polyester resin, polyvinyl chloride resin, phenolic resin, modified phenolic resin, modified maleic acid resin, acrylic resin, methacrylic resin, polyvinyl acetate, silicone resin, polyurethane resin, polyamide resin, furan resin, epoxy resin, xylene resin, polyvinyl butyral, terpene resin, coumarone-indene resin, and petroleum resin.

Styrene copolymers may be provided with copolymerization of styrene monomer with other vinyl monomers as components. Examples of the vinyl monomers may include: styrene derivatives, such a vinyltoluene; acrylic acid, acrylates, such as methyl acrylate, ethyl acrylate, butyl acrylate, dodecyl acrylate, octyl acrylate, 2-ethylhexyl acrylate and phenyl acrylate; methacrylic acid, methacrylates, such as methyl methacrylate, ethyl methacrylate, butyl methacrylate ad octyl methacrylate; dicarboxylic acids having a double bond, and esters and anhydrides thereof, such as maleic acid, butyl maleate, methyl maleate and dimethyl maleate; acrylamide, acrylonitrile, methacrylonitrile, butadiene, vinyl chloride; vinyl esters, such as vinyl acetate and vinyl benzoate; ethylenic olefins, such as ethylene, propylene and butylene; vinyl ketones, such as vinyl methyl ketone, and vinyl hexyl ketone; and vinyl ethers, such as vinyl methyl ether, vinyl ethyl ether, and vinyl isobutyl ether. These vinyl monomers may be used singly or in combination of two or more species.

It is also possible to use a crosslinking agent, comprising a compound having at least two polymerizable double bonds, examples of which may include: aromatic divinyl compounds, such as divinylbenzene and divinylnaphthalene; carboxylic acid esters having two double bonds, such as ethylene glycol diacrylate, ethylene glycol dimethacrylate, and 1,3-butanediol dimethacrylate; other divinyl compounds, such as divinylaniline, divinyl ether, divinyl sulfide, and divinyl sulfone; and compounds having three or more vinyl groups.

In case where the binder resin is a styrene-acrylic resin, the binder resin may preferably be one providing a toner with a THF-soluble content exhibiting a molecular weight distribution according to GPC showing at least one peak in a molecular weight region of 3,000–50,000, at least one peak in a molecular weight region of at least $10^5$ and a GPC areal percentage of 50–90% of a component showing molecular weights of at most $10^5$.

In case where the binder resin is a polyester resin, the binder resin may preferably be one providing a toner with a molecular weight distribution according to a similar GPC measurement exhibiting at least one peak in a molecular weight region of 3,000–50,000 and containing 60–100% of components having molecular weights of at most $10^5$. It is further preferred to provide at least one peak in a molecular weight region of 5,000–20,000.

Among them, a polyester resin shows excellent fixability and is suitable for providing a color toner.

In order to provide a color toner with a good chargeability, it is particularly preferred to use a class of polyesters obtained by cop copolycondensation of a diol component comprising a bisphenol derivative represented by the following formula (IX) together with a carboxylic acid having at least two functional groups or its anhydride or lower alkyl ester (such as fumaric acid, maleic acid maleic anhydride, phthalic acid, terephthalic acid, trimellitic acid or pyromellitic acid):

(IX)

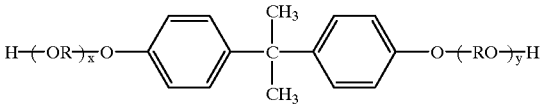

wherein R is ethylene or propylene group; x and y are independently an integer of at least 1 providing an average of x+y in the range of 2–10.

According to a preferred embodiment of the present invention, the toner may contain a wax.

Examples of hydrocarbons usable in the present invention may include: an alkylene polymer wax obtained through polymerization of an alkylene by radical polymerization under high pressure or in the presence of a Ziegler catalyst under a low pressure; an alkylene polymer wax obtained by thermal decomposition of a high-molecular weight alkylene polymer; and a synthetic hydrocarbon wax obtained by subjecting a mixture gas containing carbon monoxide and hydrogen to the Arge process to form a hydrocarbon mixture, distilling the hydrogen mixture to leave a residue and hydrogenating the residue. Among these, it is particularly suitable to use a hydrocarbon wax obtained by extracting or fractionating such hydrocarbon waxes to recover a particular fraction. Fractionation of wax may preferably be performed by the press sweating method, the solvent method, vacuum distillation or fractionating crystallization for removal or recovery of a low-molecular weight fraction.

In addition to such hydrocarbon waxes, it is also possible to use microcrystalline wax, carnauba wax, sasol wax, paraffin wax, ester wax, aliphatic solid alcohol, etc.

Such a wax may preferably have a number-average molecular weight (Mn) of 400–1200 and a weight-average molecular weight (Mw) of 600–3600 as measured corresponding to those of polyethylene. If the molecular weight is below the above-mentioned range, the resultant toner is liable to have inferior anti-blocking property and developing performance. On the other hand, in excess of the above-mentioned molecular weight range, it becomes difficult to provide good fixability and anti-offset property.

In the present invention, the wax may preferably show an Mw/Mn ratio of at most 5.0, more preferably at most 3.0.

It is effective that the wax is contained in 0.5–10 wt. parts per 100 wt. parts of the binder resin.

The colorant used in the present invention may comprise one or more species selected from know dyes and pigments, inclusive of: carbon black, lamp black, iron black, ultramarine, nigrosine dyes, Aniline Blue, Phthalocyanine Blue, Phthalocyanine Green, Hansa Yellow G, Rhodamine 6G, Chalco Oil Blue, Chrome Yellow, quinacridones, Benzidine Yellow, Rose Bengal, Triarylmethane dyes, monoazo and disazo dyes and pigments.

The toner according to the present invention can also be formulated as a magnetic toner by containing a magnetic material. Such a magnetic material may preferably have a particle size distribution variation coefficient of at most 40%. By using magnetic fine powder having a particle size distribution variation coefficient of at most 40%, it becomes possible to uniformly disperse the magnetic fine powder in the toner particles. A particle size variation coefficient of 30% or below is further preferred. Such a good dispersibility may be obtained presumably because excessively fine powder having a high agglomeratability is few. This also leads to a tendency of giving a high chargeability. The particle size distribution variation coefficient referred to herein is determined by dividing a standard deviation of particle size distribution with an average particle size (meaning a number-average particle size herein) of the magnetic fine powder.

The magnetic fine powder may preferably have an average particle size of 0.05–0.5 μm, more preferably 0.1–0.4 μm. The magnetic fine powder may preferably be contained in a magnetic toner in a proportion of 40–120 wt. parts per 100 wt. parts of the binder resin.

The magnetic fine powder used in the present invention may comprise a magnetic material, examples of which may include: oxides, such as magnetite, γ-iron oxide, ferrite, and excessive iron-containing ferrite metals, such as iron, cobalt and nickel, and alloys of these metals. These magnetic materials can further contain an additive element, examples of which may include: iron, cobalt, nickel, aluminum, copper, lead, magnesium, tin, zinc, antimony, beryllium, bismuth, cadmium, calcium, manganese, selenium, titanium, tungsten, and vanadium.

The toner according to the present invention thus-constituted by the characteristic phenol-aldehyde condensate mixture may have a volume-average particle size (almost identical to that of the toner particles before the addition of external additive) of 2.5–15 μm. A volume-average particle size of 2.5–10 μm is preferred in view of the developing performance, and 2.5–6.0 μm is preferred in order to provide a high-resolution image.

The toner according to the present invention may optionally contain further additives, examples of which may include the following.

(1) Abrasive: metal oxide (e.g., strontium titanate, cerium oxide, aluminum oxide, magnesium oxide, and chromium oxide), nitrides (e.g., silicon nitride), carbides (e.g., silicon carbide), metal salts (e.g., calcium sulfate, barium sulfate, and calcium carbonate), etc.

(2) Lubricant: powder of fluorine-containing resins (e.g., polyvinylidene fluoride, and polytetrafluoroethylene), fatty acid metal salts (e.g., zinc stearate, and calcium stearate), etc.

(3) Charge-controlling particles: particles of metal oxides (e.g., tin oxide, titanium oxide, and zinc oxide), resin particles, etc.

These additives may be added in 0.05–10 wt. parts, preferably 0.1–5 wt. parts, to 100 wt. parts of the toner particles. These additives may be used singly or in combination of two or more species.

The toner particles constituting the toner according to the present invention may preferably be prepared by sufficiently blending toner ingredients as mentioned above including the binder resin, the phenol-aldehyde condensate mixture (when internally added), the colorant, etc., by a mixing means, such as a ball mill to form a pre-mix, melt-kneading the pre-mix by a hot kneading means, such as a hot roller kneader or an extruder, cooling the kneaded product, followed by mechanical pulverization and classification to recover colored resin particles (toner particles) of a desired particle size. Alternatively, the toner particles may also be produced through other processes, inclusive of: a polymerization toner production process wherein a polymerizable monomer mixture including a monomer (mixture) for providing the binder resin and the other ingredients is dispersed or emulsified in a dispersion medium (preferably an aqueous medium) and polymerized to provide toner particles; a micro-capsule toner production process wherein the prescribed toner ingredients are incorporated in the core material or the shell material or in both of these materials; and a process wherein a binder resin solution containing the toner ingredients dispersed therein is spray-dried to provide toner particles.

The thus-obtained toner particles may be further blended with inorganic fine powder as a flowability improving agent and other optional external additive by a blending means, such as a Henschel mixer, to obtain the objective toner according to the present invention.

The toner according to the present invention can be further blended with carrier particles to provide a two-component type developer.

The carrier particles may preferably be in the form of resin-coated magnetic particles. Examples of the carrier surface-coating resin may include: styrene-acrylate copolymers, styrene-methacrylate ester copolymers, acrylate copolymers, methacrylate copolymers, silicone resins, fluorine-containing resins, polyamide resins, ionomer resins, polyphenylene sulfide resin, and mixture of these resins.

The carrier core particles may comprise a magnetic material, examples of which may include: oxides, such as magnetite, γ-iron oxide, ferrite, and excessive iron-containing ferrite metals, such as iron, cobalt and nickel, and alloys of these metals. These magnetic materials can further contain an additive element, examples of which may include: iron, cobalt, nickel, aluminum, copper, lead, magnesium, tin, zinc, antimony, beryllium, bismuth, cadmium, calcium, manganese, selenium, titanium, tungsten, and vanadium.

Particle sizes referred to herein are based on values measured in the following manner.

Coulter Multisizer II (available from Coulter Electronics Inc.) is used together with an electrolytic solution comprising a ca. 1% NaCl aqueous solution ("ISOTON-II", available from from Counter Scientific Japan). For measurement, into 10 to 150 ml of the electrolytic solution, 0.1 to 5 ml of a surfactant (preferably an alkyl benzenesulfonic acid salt) is added as a dispersant, and 2–20 mg of a sample is added. The resultant dispersion of the sample in the electrolytic solution is subjected to a dispersion treatment by an ultrasonic disperser for ca. 1–3 min., and then subjected to measurement of volume-basis and number-basis particle size distributions by using the above-mentioned apparatus to calculate a volume-average and a number average particle size, respectively.

The apparatus is equipped with a 100 μm-aperture for particles of 2–60 μm giving an average particle size of at least 6 μm, a 50 μm-aperture for particles of 1–30 μm giving an average particle size of 6–2.5 μm or a 30 μm-aperture for particles of 0.6–18 μm giving an average of below 2.5 μm.

The molecular weight (distribution) of a toner may be measured based on a chromatogram obtained by GPC (gel permeation chromatography).

In the GPC apparatus, a column is stabilized in a heat chamber at 40° C., tetrahydrofuran (THF) solvent is caused to flow through the column at that temperature at a rate of 1 ml/min., and 50–200 μl of a GPC sample solution adjusted at a concentration of 0.05–0.6 wt. % is injected. In the case of a starting binder resin, the GPC sample solution may be prepared by passing the binder resin through a roll mill at 130° C. for 15 min. and dissolving the rolled resin in THF and, in the case of a toner sample, the GPC sample solution may be prepared by dissolving the toner in THF and then filtrating the solution through a 0.2 μm-filter to recover a THF-solution. The identification of sample molecular weight and its molecular weight distribution is performed based on a calibration curve obtained by using several monodisperse polystyrene samples and having a logarithmic scale of molecular weight versus count number. The standard polystyrene samples for preparation of a calibration curve may be available from, e.g., Pressure Chemical Co. or Toso K.K. It is appropriate to use at least 10 standard polystyrene samples inclusive of those having molecular weights of, e.g., $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ and $4.48\times10^6$. The detector may be an RI (refractive index) detector. For accurate measurement, it is appropriate to constitute the column as a combination of several commercially available polystyrene gel columns in order to effect accurate measurement in the molecular weight range of $10–2\times10^6$. A preferred example thereof may be a combination of μ-styragel 500, $10^3$, $10^4$ and $10^5$ available from Waters Co.; or a combination of Shodex KA-801, 802, 803, 804, 805, 806 and 807 available from Showa Denko K.K.

The molecular weight (distribution) of a wax may be measured by GPC under the following conditions:

Apparatus: "GPC-150C" (available from Waters Co.)

Column: "GMH-HT" 30 cm-binary (available from Toso K.K.)

Temperature: 135° C.

Solvent: o-dichlorobenzene containing 0.1% of ionol.

Flow rate: 1.0 ml/min.

Sample: 0.4 ml of a 0.15%-sample.

Based on the above GPC measurement, the molecular weight distribution of a sample is obtained once based on a calibration curve prepared by monodisperse polystyrene standard samples, and recalculated into a distribution corresponding to that of polyethylene using a conversion formula based on the Mark-Houwink viscosity formula.

Hereinbelow, the present invention will be described more specifically based on Examples, wherein "part(s)" used for describing a relative amount of a component is by weight unless otherwise noted specifically.

EXAMPLE 1

| | |
|---|---|
| Propoxidized bisphenol | 52 mol. % |
| Fumaric acid | 40 mol. % |
| Terephthalic acid | 5 mol. % |
| Trimellitic anhydride | 1 mol. % |

The above ingredients were subjected to polycondensation to form Binder resin (1).

<Cyan Toner Composition>

| | |
|---|---|
| Binder resin (1) | 100 parts |
| Copper phthalocyanine pigment | 3 parts |
| Acyclic/cyclic condensate mixture (1) ($D_1$ = 2.8 μm) | 2 parts |

<Yellow Toner Composition>

| | |
|---|---|
| Binder resin (1) | 100 parts |
| C.I. Pigment Yellow 17 | 5 parts |
| Acyclic/cyclic condensate mixture (1) ($D_1$ = 2.8 μm) | 2 parts |

For each toner composition, the pigment was pre-dispersed in the binder resin and Acyclic/cyclic condensation mixture (1) was added thereto and blended sufficiently in a blender. The resultant blend was melt-kneaded through a twin-screw kneading extruder set at 110° C. to provide a kneaded product, which was then cooled, coarsely crushed and finely pulverized by a fine pulverizer using a jet air stream. The resultant fine pulverizate was classified by a multi-division classifier utilizing the Coanda effect to recover blue-colored resin particles (blue toner particles) having a volume-average particle size (Dv) of 5.7 μm and yellow-colored resin particles (yellow toner particles) of Dv=5.9 μm.

100 parts each of the cyan and yellow toner particles were respectively blended with 1.5 part of hydrophobic alumina fine powder (hydrophobicity (HP)=65%, average particle size ($D_1$)=18 nm) hydrophobized with n-butyltrimethoxysilane in a Henschel mixer to provide a cyan toner and a yellow toner, respectively.

Then, 6 parts of the cyan toner (corresponding to ca. 330 A4-sheet size images having an image percentage of 20%) was blended with 94 parts of carrier particles formed by coating ferrite particles ($D_1$=45 μm) with silicone resin to provide a cyan developer.

The cyan developer was incorporated in a developing device of a commercially available color electrophotographic copying machine ("CLC-700", made by Canon K.K.), and a continuous copying test was started in an environment of 23° C./5% RH while continually replenishing the above-prepared yellow toner so as to keep the toner concentration of 6 wt. %. As a result, the resultant images were gradually tinted with yellow and changed from cyan to yellow. By measurement of reflection spectrum from the resultant images, an almost complete exchange into yellow was confirmed in formation of ca. 400 A4-sheet size images having an areal image percentage of 20%.

As a result of a continuous image formation on 30,000 sheets with the cyan developer while replenishing the cyan toner as desired in an environment of 23° C./5% RH, good images having a density of 1.48 could be formed from the initial stage. After copying on 30,000 sheets, the resultant images showed a density of 1.47 and were good images including an image sharpness and a smooth halftone image. The cyan developer in an as-prepared state and the cyan developer taken out of the developing device after the 30,000 sheets of continuous image were subjected to a triboelectric chargeability measurement in a manner described hereinafter to show toner chargeabilities of −25 μC/g and −24 μC/g, respectively.

Also in an environment of 23° C./80% RH, a continuous image formation on 30,000 sheets was performed with the cyan toner. As a result, good image having a density of 1.42 could be obtained from the initial stage. Even after copying on 30,000 sheets, the resultant images showed a density of 1.45 and were good images including an image sharpness and a smooth halftone image. The cyan developer in an as-prepared state and the cyan developer taken out of the developing device after the 30,000 sheets of continuous image formation were found to show toner chargeabilities of −25 μC/g and −23 μC/g, respectively.

Further, as a result of a toner scattering test in the environment of 30° C./80% RH, the toner showed a toner scattering of 0.1 g (as an amount of toner having fallen onto an A4-sheet disposed directly below the developing sleeve of the developing device after 3 min. of blank rotation of the sleeve as measured in a manner described hereinafter).

The results are inclusively shown in Table A appearing hereinafter together with those of Examples and Comparative Examples described below.

EXAMPLE 2

A cyan toner and a yellow toner were prepared in the same manner as in Example 1 except that Acyclic/cyclic condensate mixture (1) was replaced by Acyclic/cyclic condensate mixture (8). ($D_1$=3.1 μm).

These toners were evaluated in the same manner as in Example 1. The results are also shown in Table A.

EXAMPLE 3

A cyan toner and a yellow toner were prepared in the same manner as in Example 1 except that Acyclic/cyclic condensate mixture (1) was replaced by Acyclic/cyclic condensate mixture (2). ($D_1$=2.9 μm).

These toners were evaluated in the same manner as in Example 1. The results are also shown in Table A.

EXAMPLE 4

A cyan toner and a yellow toner were prepared in the same manner as in Example 1 except that Acyclic/cyclic condensate mixture (1) was replaced by Acyclic/cyclic condensate mixture (3). ($D_1$=3.2 μm).

These toners were evaluated in the same manner as in Example 1. The results are also shown in Table A.

EXAMPLE 5

A cyan toner and a yellow toner were prepared in the same manner as in Example 1 except that Acyclic/cyclic condensate mixture (1) was replaced by Acyclic/cyclic condensate mixture (4). ($D_1$=2.9 μm).

These toners were evaluated in the same manner as in Example 1. The results are also shown in Table A.

EXAMPLE 6

A cyan toner and a yellow toner were prepared in the same manner as in Example 1 except that Acyclic/cyclic condensate mixture (1) was replaced by Acyclic/cyclic condensate mixture (6). ($D_1$=3.1 μm).

These toners were evaluated in the same manner as in Example 1. The results are also shown in Table A.

EXAMPLE 7

A cyan toner and a yellow toner were prepared in the same manner as in Example 1 except that Acyclic/cyclic condensate mixture (1) was replaced by Acyclic/cyclic condensate mixture (7). ($D_1$=3.0 μm).

These toners were evaluated in the same manner as in Example 1. The results are also shown in Table A.

EXAMPLE 8

A cyan toner and a yellow toner were prepared in the same manner as in Example 1 except that Acyclic/cyclic condensate mixture (1) was replaced by Acyclic/cyclic condensate mixture (9). ($D_1$=3.0 μm).

These toners were evaluated in the same manner as in Example 1. The results are also shown in Table A. Further, as a result of inspection of the fixing device after the continuous image formation, the cleaning web exhibited noticeable soiling compared with that in Example 1.

Comparative Example 1

0.40 mol of p-phenylphenol, 0.70 mol of paraformaldehyde and 0.8 ml of 10 mol/liter-potassium hydroxide aqueous solution, were heated under stirring in 300 ml of xylene to distill off the water. The product was cooled and filtrated to recover a precipitate, which was then washed with ethanol and dried to obtain White powder (1).

White powder (1) was subjected to preparative chromatography and purification to isolate Cyclic condensate (A)

having 8 phenolic units. Thus, Cyclic condensate (A) was characterized as follows:

Cyclic condensate/acyclic condensate =100/0

$Pu_{1-3}$ content=0 wt. %

$Pu_{4-6}$ content=0 wt. %

A cyan toner and a yellow toner were prepared in the same manner as in Example 1 except that Acyclic/cyclic condensate mixture (1) was replaced by Cyclic condensate (A). ($D_1$=3.5 μm).

These toners were evaluated in the same manner as in Example 1. The results are also shown in Table A.

Comparative Example 2

A cyan toner and a yellow toner were prepared in the same manner as in Example 1 except that Acyclic/cyclic condensate mixture (1) was replaced by Acyclic/cyclic condensate mixture (5). ($D_1$=3.2 μm).

These toners were evaluated in the same manner as in Example 1. The results are also shown in Table A.

Comparative Example 3

A cyan toner and a yellow toner were prepared in the same manner as in Example 1 except that Acyclic/cyclic condensate mixture (1) was replaced by Cyclic condensate mixture (R-1). ($D_1$=2.9 μm).

These toners were evaluated in the same manner as in Example 1. The results are also shown in Table A.

EXAMPLE 9

| | |
|---|---|
| Styrene | 75 part(s) |
| Butyl acrylate | 20 part(s) |
| Monobutyl maleate | 5 part(s) |
| 2,2-Bis(4,4-di-t-butylperoxy-carboxycyclohexyl)propane | 0.1 parts(s) |
| Benzoyl peroxide | 0.1 part(s) |

The above composition was subjected to suspension polymerization to obtain Polymerizate (a).

| | |
|---|---|
| Styrene | 83 parts |
| Butyl acrylate | 17 parts |
| Di-tert-butyl peroxide | 2 parts |

The above composition was subjected to solution polymerization in xylene solvent to obtain Polymerizate (b).

The above-obtained Polymerizate (a) and Polymerizate (b) and polypropylene wax (Mn=310, Mw=1330) were mixed at weight ratios of 30:70:3 in solution to obtain Binder resin (2).

| | |
|---|---|
| Binder resin (2) | 100 parts |
| Magnetite | 90 parts |
| Acyclic/cyclic condensate mixture (1) ($D_1$ = 2.8 μm) | 1 part |

The above ingredients were sufficiently blended in a blender and melt-kneaded through a twin-screw kneading extruder set at 130° C. to provide a kneaded product, which was then cooled, coarsely crushed and finely pulverized y a fine pulverizer using a jet air stream. The resultant fine pulverizate was classified by a multi-division classifier utilizing the Coanda effect to recover black resin particles (magnetic toner particles) having a volume-average particle size (Dv) of 6.5 μm.

100 parts of the magnetic toner particles was blended with 1.0 part of hydrophobic silica fine powder (hydrophobicity (HP)=71%, $D_1$=11 nm) hydrophobized with hexamethyldisilazane and 3.0 parts of strontium titanate ($D_1$=200 nm) in a Henschel mixer to provide a magnetic toner.

The above-prepared magnetic toner was subjected to a continuous copying test on 10,000 sheets in an environment of 23° C./5% RH by using a commercially available electrophotographic copying machine ("GP-55", made by Canon K.K.). As a result, clear black images having an image density of 1.37 were formed from the initial stage and thereafter the image densities were retained in the range of 1.40±0.03. Thereafter, a continuous copying test on 20,000 sheets was performed in an environment of 30° C./80 % RH, whereby the image densities were retained in the range of 1.35±0.08, and fog-free images were obtained.

EXAMPLE 10

| | |
|---|---|
| Binder resin (2) prepared in Example 9 | 100 parts |
| Copper phthalocyanine pigment | 5 parts |
| Acyclic/cyclic condensate mixture (1) | 3 parts |

Cyan toner particles (Dv.=8.5 μm) were prepared from the above ingredients otherwise in the same manner as in Example 1. The cyan toner particles in 100 parts were blended with 1.3 parts of titanium fine powder treated with dimethylsilicone oil (HP=50 %, D1=14 nm) to obtain a cyan toner.

The cyan toner was subjected to a continuous copying test by using a commercially available coping machine ("FC-310", made by Canon K.K.) remodeled for a negative toner and equipped with a remodeled developing device for a non-magnetic mono-component type developer. As a result, fog-free clear images were formed with an image density of 1.49 from the initial stage. Even after copying on 1000 sheets, clear images having a density of 1.45 were obtained.

EXAMPLE 11

A magenta toner (Dv=6.5 μm) and a black toner (Dv=7.2 μm) were respectively prepared in the same manner as in Example 1 except for using 5 parts of C.I. Pigment Red 122 and 5 parts of carbon black, respectively, as the colorants.

These toners were formulated into two-component type developers similarly as in Example 1. The resultant magenta developer and black developer were incorporated in a commercially available full-color copying machine ("CLC-700", made by Canon K.K.) together with the cyan toner and the yellow toner prepared in Example 1, whereby a full-color copying test was performed. As a result, images were provided with a good color reproducibility at highlight portions and with a smooth image quality of uniform dots. Mono-color images exhibited image densities of 1.50 (for cyan), 1.51 (for yellow), 1.47 (for magenta) and 1.45 (for black). Thereafter, a continuous copying test was performed on 10,000 sheets, during which there resulted in only a small image density change, and images after 10,000 sheets exhibited an image quality identical to that of images formed at the initial stage.

The results of the evaluation in the above-described Examples and Comparative Examples are inclusively shown in Table A.

The evaluation methods and standards for some items shown in Table 1 are supplemented below.

<Image Quality>

A: Sharp images and smooth halftone images, were found.

B: Sharp images were formed but halftone images were somewhat inferior in smoothness.

TABLE A

| | 23° C./5% | | | | | | 30° C./80% | | | | | |
|---|---|---|---|---|---|---|---|---|---|---|---|---|
| | Image density | | Toner charge (μC/g) | | | | Image density | | Toner charge (μC/g) | | | Toner |
| Ex. or Comp.Ex. | Initial | Afer 30000 sheets | Initial | After 30000 sheets | Image quality | Exchange test (sheets) | Initial | After 30000 sheets | Initial | After 30000 sheets | Image quality | scat-tering (g) |
| Ex. | | | | | | | | | | | | |
| 1 | 1.48 | 1.47 | −25 | −24 | A | 400 | 1.42 | 1.45 | −25 | −23 | A | 0.1 |
| 2 | 1.49 | 1.48 | −26 | −25 | A | 400 | 1.41 | 1.44 | −24 | −24 | A | 0.1 |
| 3 | 1.49 | 1.47 | −24 | −25 | A | 500 | 1.39 | 1.42 | −26 | −24 | A | 0.4 |
| 4 | 1.44 | 1.45 | −21 | −22 | B | 600 | 1.37 | 1.39 | −20 | −20 | B | 0.4 |
| 5 | 1.52 | 1.50 | −21 | −21 | B | 600 | 1.38 | 1.44 | −20 | −20 | B | 0.4 |
| 6 | 1.51 | 1.44 | −26 | −26 | A | 500 | 1.42 | 1.44 | −24 | −23 | A | 0.3 |
| 7 | 1.55 | 1.48 | −25 | −24 | A | 500 | 1.45 | 1.47 | −25 | −23 | A | 0.3 |
| 8 | 1.46 | 1.49 | −24 | −25 | A | 500 | 1.38 | 1.42 | −24 | −24 | A | 0.3 |
| Comp.Ex. | | | | | | | | | | | | |
| 1 | 1.47 | 1.42 | −22 | −16 | B | 800 | 1.33 | 1.34 | −22 | −14 | C | 0.5 |
| 2 | 1.48 | 1.48 | −20 | −18 | B | 650 | 1.32 | 1.34 | −20 | −16 | C | 0.3 |
| 3 | 1.45 | 1.43 | −20 | −19 | B | 700 | 1.34 | 1.37 | −20 | −17 | B | 0.4 |

C: The resultant images were somewhat inferior both in image sharpness and halftone image smoothness.

<Toner Scattering>

In a test environment, 7 parts of a sample toner and 93 parts of a carrier were leftstanding for at least two nights. In the same environment, a Turbula mixer, a developing device (for "CLC-500", etc.) disposed in a horizontal position with a photosensitive drum and a blank rotation drive mechanism for the developing device, were provided. The toner and the carrier were blended together for 2 min. in the Turbula mixer, and the resultant developer was charged in the developing device, which was then set on the blank rotation drive mechanism. An A4-size sheet of paper was placed with its center directly below the sleeve of the developing device, and the sleeve was subjected to blank rotation for 3 min. The amount of toner having fallen on the paper during the 3 min. was measured, and the weight was indicated as a measure of toner scattering.

<Triboelectric Chargeability>

The sole figure in the drawing is an illustration of an apparatus for measuring a toner triboelectric charge. A developer in an as-prepared state or a developer taken out of a developing device of a copying machine or a printer after a copying test, in a weight of ca. 0.5–0.8 g, is placed in a metal measurement vessel 2 bottomed with a 500-mesh screen 3 and then covered with a metal lid 4. The weight of the entire measurement vessel 2 at this time is weighed at $W_1$ (g). Then, an aspirator 1 (composed of an insulating material at least with respect to a portion contacting the measurement vessel 2) is operated to suck the toner through a suction port 7 while adjusting a gas flow control valve 6 to provide a pressure of 250 mmAq (2.45 kPa) at a vacuum gauge 5. Under this state, the toner is sufficiently removed by sucking, preferably for 2 min.

The potential reading on a potentiometer 9 at this time is denoted by V (volts) while the capacitance of a capacitor 8 is denoted by C (mF), and the weight of the entire measurement vessel is weighed at $W_2$ (g). Then, the triboelectric charge Q (μC/g) of the sample toner is calculated by the following equation:

$$Q\ (\mu C/g) = C \times V/(W_1 - W_2).$$

What is claimed is:

1. A toner for developing electrostatic images, comprising: toner particles comprising a binder resin and a colorant, and inorganic fine powder, wherein the toner further contains: a phenol-aldehyde condensate mixture comprising an acyclic condensate and a cyclic condensate, respectively, of a phenol compound with an aldehyde compound, and the phenol-aldehyde condensate mixture contains 10–80 mol % of condensate components having 4–6 phenolic units.

2. The toner according to claim 1, wherein the phenol-aldehyde condensate mixture contains 20–70 mol % of the condensate components having 4–6 phenolic units.

3. The toner according to claim 1, wherein the phenol-aldehyde condensate mixture contains 10–80 mol % of the condensate components having 1–3 phenolic units.

4. The toner according to claim 1, wherein the phenol-aldehyde condensate mixture contains 20–70 mol % of the condensate components having 1–3 phenolic units.

5. The toner according to claim 1, wherein 0.1–10 wt. parts of the phenol-aldehyde condensate mixture per 100 wt. parts of the binder resin is incorporated in the toner particles.

6. The toner according to claim 1, wherein 0.01–5 wt. parts of the phenol-aldehyde condensate mixture per 100 wt. parts of the binder resin is externally added in the toner particles.

7. The toner according to claim 1, wherein the phenol-aldehyde condensate mixture contains the acyclic condensate and the cyclic condensate at a mol ratio of 1:20 to 30:1.

8. The toner according to claim 1, wherein the phenol-aldehyde condensate mixture includes a condensate component having a structural unit comprising a combination of formulae (I) and (II) shown below:

(I)

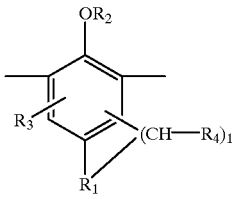

(II)

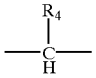

wherein i is 0 or 1;

if i is 0, $R_1$ is hydrogen atom, halogen atom, alkyl group, aryl group, aryl group having a substituent, aralkyl group, alicyclic group, alicyclic group having a substituent, fluoroalkyl group, nitro group, sulfonyl group, sulfonyl group having a substituent, amino group, amino group having a substituent, or trialkylsilyl group;

if i is 1, $R_1$ is alkylene group, arylene group, arylene group having a substituent, aralkylene group, alicyclic group, alicyclic group having a substituent, imino group, imino group having a substituent, or trialkylsilylene group;

$R_2$ is hydrogen atom, alkyl group, phenyl group, aralkyl group, —$COR_5$— ($R_5$ is hydrogen atom or alkyl group) or —$(CH_2)_mCOOR_6$ ($R_6$ is hydrogen atom or alkyl group, m is an integer of 1–3);

$R_3$ is hydrogen atom, alkyl group, halogen atom, carboxyl group, hydroxy group, cyano group, nitro group, halogenated alkyl group, trialkylsilyl group, an alkoxycarbonyl, aryloxycarbonyl or acyloxy group having 1–8 carbon atoms, amino group, amino group having a substituent, acyl group, sulfon group, sulfon group having a substituent, or an alkoxy or aryloxy group having 1–8 carbon atoms; and $R_4$ is hydrogen atom or alkyl group.

9. The toner according to claim 8, wherein the phenol-aldehyde condensate mixture includes a condensate component having a structural unit comprising a combination of formula (I) wherein $R_1$ is phenyl or alkyl and formula (II) wherein $R_4$ is hydrogen or alkyl.

10. The toner according to claim 8, wherein the phenol-aldehyde condensate mixture includes a condensate component having a structural unit of formula (III) shown below:

(III)

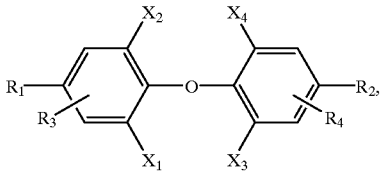

wherein $R_1$ and $R_2$ are independently hydrogen atom, halogen atom, alkyl group, aryl group, aryl group having a substituent, aralkyl group, alicyclic group alicyclic group having a substituent, fluoroalkyl group, nitro group, sulfon group, sulfon group having a substituent, amino group, amino group having a substituent, or trialkylsilyl group;

$R_3$ and $R_4$ are independently hydrogen atom, alkyl group, halogen atom, carboxyl group, hydroxy group, cyano group, nitro group, halogenated alkyl group, trialkylsilyl group, an alkoxycarbonyl, aryloxycarbonyl or acyloxy group having 1–8 carbon atoms, amino group, amino group having a substituent, acyl group, sulfon group, sulfon group having a substituent, or an alkoxy or acyloxy group having 1–8 carbon atoms;

$X_1$, $X_2$, $X_3$ and $X_4$ denote bond positions capable of forming a ring with the unit of formula (I) or (III) via the unit of formula (II), and denote hydrogen atom, alkyl group or hydroxyalkyl group in the case of a terminal.

11. The toner according to claim 10, wherein the phenol-aldehyde condensate mixture includes a condensate component having a structural unit of formula (III) wherein $R_1$ and $R_2$ are independently phenyl or alkyl.

12. The toner according to claim 8 or 10, wherein the phenol-aldehyde condensate mixture includes a condensate component having a terminal structure represented by formula (IV) shown below:

(IV)

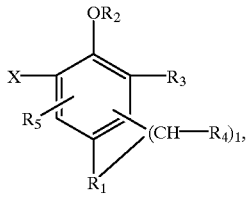

wherein i is 0 or 1;

if i is 0, $R_1$ denotes hydrogen atom, halogen atom, alkyl group, aryl group, aryl group having a substituent, aralkyl group, alicyclic group, alicyclic group having a substituent, fluoroalkyl group, nitro group, sulfonyl group, sulfonyl group having a substituent, amino group, amino group having a substituent, or trialkylsilyl group;

if i is 1, $R_1$ alkylene group, arylene group, arylene group having a substituent, aralkylene group, alicyclic group, alicyclic group having a substituent, imino group, imino group having a substituent or trialkylsilylene group;

$R_2$ is hydrogen atom, alkyl group, phenyl group, aralkyl group, —$COR_6$— ($R_6$ is hydrogen atom or alkyl group) or —$(CH_2)_mCOOR_7$ ($R_7$ is hydrogen atom or alkyl group, m is an integer of 1–3);

$R_3$ and $R_4$ are hydrogen atom or alkyl group;

$R_5$ is hydrogen atom, alkyl group, halogen atom, carboxyl group, hydroxy group, cyano group, nitro group, halogenated alkyl group, trialkylsilyl group, an alkoxycarbonyl, aryloxycarbonyl or acyloxy group having 1–8 carbon atoms, amino group, amino group having a substituent, acyl group, sulfon group, sulfon group having a substituent, or an alkoxy or aryloxy group having 1–8 carbon atoms; and X denotes a bond position and is bonded to the unit of formula (I) or (III) via the unit of Formula (II).

13. The toner according to claim 12, wherein $R_1$ in the formula (IV) is phenyl or alkyl.

14. The toner according to claim 1, wherein the phenol-aldehyde condensate mixture includes a condensate component having a structural unit comprising a combination of formulae (V) and (VI) shown below:

(V)

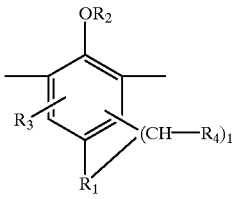

(VI)

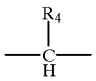

wherein i is 0 or 1;

if i is 0, $R_1$ is alkyl group, aralkyl group, alicyclic group, fluoroalkyl group, acryl group, or aryl group having a substituent selected from halogen atom, alkyl group and fluoroalkyl group;

if i is 1, $R_1$ is alkylene group, aralkylene group, alicyclic group, fluoroalkylene group, arylene group, or arylene group having a substituent;

$R_2$ is hydrogen atom or alkyl group;

$R_3$ is hydrogen atom, alkyl group, halogen atom or nitro group; and $R_4$ is hydrogen atom or alkyl group.

15. The toner according to claim 14, wherein the phenol-aldehyde condensate mixture includes a condensate component having a structural unit comprising a combination of formula (V) wherein $R_1$ is phenyl or alkyl and formula (VI) wherein $R_4$ is hydrogen or alkyl.

16. The toner according to claim 14, wherein the phenol-aldehyde condensate mixture includes a condensate component having a structural unit of formula (VII) shown below:

(VII)

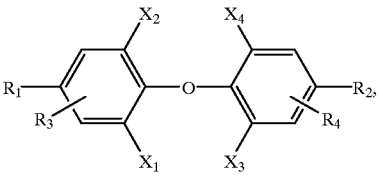

wherein $R_1$ and $R_2$ are independently alkyl group, aralkyl group, alicyclic group, fluoroalkyl group, aryl group or aryl group having a substituent;

$R_3$ and $R_4$ are independently hydrogen atom or alkyl group; and $X_1$, $X_2$, $X_3$ and $X_4$ denote bond positions capable of forming a ring with the unit of formula (V) or (VII) via the unit of formula (VI), and denote hydrogen atom, alkyl group or hydroxyalkyl group in the case of a terminal.

17. The toner according to claim 16, wherein the phenol-aldehyde condensate mixture includes a condensate component having a structural unit of formula (VII) wherein $R_1$ and $R_2$ are independently phenyl or alkyl.

18. The toner according to claim 14 or 16, wherein the phenol-aldehyde condensate mixture includes a condensate component having a terminal structure represented by formula (VIII) shown below:

(VIII)

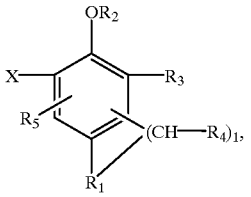

wherein $R_1$ is alkyl group, aralkyl group, alicyclic group, fluoroalkyl group, aryl group or aryl group having a substituent selected from halogen atom, alkyl group and fluoroalkyl group;

$R_2$, $R_3$ and $R_4$ are independently hydrogen atom or alkyl group; and

X denotes a bond position and is bonded to the unit of (V) or (VII) via the unit of formula (VI).

19. The toner according to claim 18, wherein $R_1$ in the formula (VIII) is phenyl or alkyl.

20. The toner according to claim 1, wherein the phenol compound is a compound selected from the group consisting of: phenol; phenol derivatives obtained by replacing a hydrogen atom in the phenolic OH group of phenol with a substituent selected from an alkyl group, an aryl group, an aralkyl group and an acyl group; and phenol and such a phenol derivative as described above further having at their p-position a substituent selected from an alkyl group, an aralkyl group, an alicyclic group, an aryl group, an aryl group substituted with halogen, alkyl or fluoroalkyl, a fluoroalkyl group, a sulfon group, an amino group, or a silyl group.

21. The toner according to claim 1, wherein the phenol compound is a compound selected from the group consisting of phenols including phenol, p-methylphenol, p-ethylphenol, p-propylphenol, p-i-butylphenol, p-pentylphenol, p-hexylphenol, p-heptylphenol, p-octylphenol, p-t-octylphenol, p-nonylphenol, p-decylphenol, p-cyclohexylphenol, p-cyclopentylphenol, p-phenylphenol, p-(4-chlorophenyl)phenol, p-(4-fluorophenol)phenol, p-cumylphenol, p-chlorophenol, p-fluorophenol, p-trifluoromethylphenol, p-perfluoroalkylphenol, p-benzylphenol, p-trimethylsilylphenol, p-nitrophenol, p-sulfophenol, and p-aminophenol; and phenol derivatives obtained by subjecting the phenolic hydroxyl group in the above-mentioned phenols to alkylene, arylation, aralkylation or acylation.

22. The toner according to claim 1, wherein the aldehyde compound is a compound selected from the group consisting of formaldehyde, acetaldehyde, propionaldehyde, benzaldehyde, butylaldehyde, valeroaldehyde, acrylaldehyde, salicylaldehyde, cinnamalaldehyde, p-tolualdehyde, p-chlorobenzaldehyde and anisaldehyde.

23. The toner according to claim 1, wherein the aldehyde compound is ia compound selected from the group consisting of formaldehyde, acetaldehyde and benzaldehyde.

24. The toner according to claim 1, wherein the acyclic condensate comprises at least one species of condensation product between p-phenylphenol or a p-alkylphenol having a p-alkyl substituent of at most 10 carbon atoms and formaldehyde or acetaldehyde.

25. The toner according to claim 1, wherein the cyclic condensate comprises at least one species of condensation product between p-phenylphenol or a p-alkylphenol having a p-alkyl substituent of at most 10 carbon atoms and formaldehyde or acetaldehyde.

26. The toner according to claim 1, which is a color toner.

27. The toner according to claim 26, wherein the color toner is a magenta toner, a cyan toner or a yellow toner.

28. The toner according to claim 1, having a volume-average particle size of 2.5–15 $\mu$m.

29. The toner according to claim 1, having a volume-average particle size of 2.5–10 $\mu$m.

30. The toner according to claim 1, having a volume-average particle size of 2.5–6 $\mu$m.

* * * * *

UNITED STATES PATENT AND TRADEMARK OFFICE

CERTIFICATE OF CORRECTION

PATENT NO. : 5,972,554

DATED : October 26, 1999

INVENTOR(S) : TAKAYUKI NAGATSUKA ET AL.

It is certified that error appears in the above-identified patent and that said Letters Patent is hereby corrected as shown below:

COLUMN 2

Line 4, "tured" should read --ture--; and
Line 38, "quicklyconsumed" should read --quickly consumed--.

COLUMN 3

Line 16, "include" should read --including--; and
Line 34, "used a" should read --used as a--.

COLUMN 7

Line 63, "(1) most" should read --(1) is most--; and
Line 67, "binder" should read --hinder--.

COLUMN 17

Line 26, "following" should read --following Table 5.--.

COLUMN 30

Line 3, "48.4 mol %." should read --8.4 mol %.--.

COLUMN 31

Line 29, "exhibit" should read --exhibited--.

UNITED STATES PATENT AND TRADEMARK OFFICE

CERTIFICATE OF CORRECTION

PATENT NO. : 5,972,554

DATED : October 26, 1999

INVENTOR(S) : TAKAYUKI NAGATSUKA ET AL.

It is certified that error appears in the above-identified patent and that said Letters Patent is hereby corrected as shown below:

COLUMN 32

Line 9, "such a" should read --such as--;
Line 14, "ad octyl" should read --and octyl--;
Line 60, "cop"should be deleted; and
Line 65, "acid maleic" should read --acid, maleic--.

COLUMN 33

Line 20, "mixture gas" should read --mixture of gas--; and
Line 64, "few." should read --in a low concentration.--.

COLUMN 35

Line 31, "from" (second occurrence) should be deleted.

COLUMN 36

Line 9, "$10-2\times10^{6}$," should read --$10^{3}-2\times10^{6}$,--; and
Line 10, "$\mathbf{10^{4}}$" --not bold face.

COLUMN 39

Line 64, "y a" should read --by a--.

COLUMN 40

Line 35, "coping" should read --copying--; and
Line 61, "in only" should read --only--.

UNITED STATES PATENT AND TRADEMARK OFFICE

CERTIFICATE OF CORRECTION

PATENT NO. : 5,972,554

DATED : October 26, 1999

INVENTOR(S) : TAKAYUKI NAGATSUKA ET AL.

It is certified that error appears in the above-identified patent and that said Letters Patent is hereby corrected as shown below:

COLUMN 41

Line 5, "found" should read --formed--; and
Line 36, "leftstanding" should read --left standing--.

COLUMN 43

Line 64, "group" (second occurrence) should read --group,--.

COLUMN 46

Line 61, "ia compound" should read --a compound--.

Signed and Sealed this

Twenty-fifth Day of July, 2000

*Attest:*

*Attesting Officer*

Q. TODD DICKINSON

*Director of Patents and Trademarks*